US011087649B2

(12) United States Patent
Anderson

(10) Patent No.: US 11,087,649 B2
(45) Date of Patent: Aug. 10, 2021

(54) GRAPHIC DISPLAY FRAME AND EXTENSION

(71) Applicant: Rick D. Anderson, Minneapolis, MN (US)

(72) Inventor: Rick D. Anderson, Minneapolis, MN (US)

( * ) Notice: Subject to any disclaimer, the term of this patent is extended or adjusted under 35 U.S.C. 154(b) by 0 days.

(21) Appl. No.: 16/381,135

(22) Filed: Apr. 11, 2019

(65) Prior Publication Data

US 2020/0005685 A1 Jan. 2, 2020

Related U.S. Application Data

(60) Provisional application No. 62/655,948, filed on Apr. 11, 2018, provisional application No. 62/711,901, filed on Jul. 30, 2018.

(51) Int. Cl.
*G09F 13/04* (2006.01)

(52) U.S. Cl.
CPC ..... *G09F 13/0413* (2013.01); *G09F 13/0445* (2021.05)

(58) Field of Classification Search
CPC ..... G09F 13/0445
See application file for complete search history.

(56) References Cited

U.S. PATENT DOCUMENTS

| | | | | | |
|---|---|---|---|---|---|
| 4,403,434 | A * | 9/1983 | Jenkins | A47G 1/102 | 40/785 |
| 4,548,379 | A * | 10/1985 | Seely | G09F 7/22 | 248/160 |
| 5,479,733 | A * | 1/1996 | Kusina | G09F 1/12 | 40/785 |
| 8,984,781 | B2 * | 3/2015 | Gimpel | G09F 13/04 | 40/605 |
| 2006/0042141 | A1 * | 3/2006 | Hansen | E04B 2/7422 | 40/782 |
| 2009/0178321 | A1 * | 7/2009 | Kucharski | A47G 1/08 | 40/700 |
| 2010/0202827 | A1 * | 8/2010 | Frey | A47G 1/10 | 403/359.3 |
| 2015/0143729 | A1 * | 5/2015 | Pyc | G09F 15/0012 | 40/607.1 |
| 2019/0290028 | A1 * | 9/2019 | Hatton | A47G 1/0605 | |

* cited by examiner

*Primary Examiner* — Kristina N Junge
(74) *Attorney, Agent, or Firm* — Taft Stettinius & Hollister LLP; Daniel A. Rosenberg

(57) ABSTRACT

The present invention relates to a graphic display frame for use with SEG graphic displays of a modular design. The frame comprises a system that can be used to construct frames of various sizes, shapes, and dimensions. The frame system includes channel members, connectors, brackets, and other components that can be constructed and used to support SEG graphics.

19 Claims, 32 Drawing Sheets

GRAPHIC DISPLAY FRAME AND EXTENSION

RELATED APPLICATIONS

The present application claims priority to and incorporates by reference U.S. Provisional Patent Application Nos. 62/655,948 filed Apr. 11, 2018, and 62/711,901 filed Jul. 30, 2018.

BACKGROUND OF THE INVENTION

Field of the Invention

The present invention relates to a graphic display frame, and in particular, to a modular plastic molded frame for use with silicon edge graphic ("SEG") displays.

Background

SEGs are a printed fabric material particularly suited for use with extrusion-based displays, or displays featuring channel bar applications. SEG graphics feature a silicone edge gasket attached to one or more edges of the printed graphic, enabling the edge to pressure fit into a channel on a frame to present a seamless display surface.

SEGs are ideal for use with a multitude of different display products, and for use with backlit LED illuminated and non-illuminated dye-sublimated fabric graphics. On advantage of SEGs is that they can be held firmly in place and the fabric is stretched under tension to provide a seamless and wrinkleless appearance for dramatic effect. Thus, it is important to use a material with some stretch to allow for easy installation and to keep the graphic taught in the frame system. SEGs produced with fabrics without suitable stretch may fit poorly on the frame and sag after multiple uses.

Application and removal of SEGs is easy. Initially, the SEG edge bead is pressed into one or more corners of the frame to ensure that graphic will be properly aligned once fitted. Then the edge bead is pressed into the perimeter channels usually with the fingers (a tool can be used) until all the edge beading is pushed into the channels. Removal is as simple as pulling the tab located on the graphic to remove a portion of the graphic from the channel, and then gently pulling the rest of the beaded edge out of the frame channel.

A drawback of prior art SEG systems is that the tension on the fabric creates stress on the frames forcing the frame members to bend and deform. As a result, the frame members need to be constructed of very strong materials such as aluminum, and even then, frames of even moderate size will tend to bend and deform from the tension created by the stretched graphic. This makes it very difficult to have large SEG graphic displays, and increases the cost and weight of existing frames because of the cost of the materials that need to be used to withstand the force on the frame members.

Another drawback of SEG systems is that they do not provide the ability to create multidimensional displays because the fabric covers the frame and does not provide a surface that allows for attachments.

Thus, a need exists for a SEG graphic display frame system that better withstands the bending forces, that can be constructed of more desirable materials, and that can create multidimensional displays.

DETAILED DESCRIPTION OF THE INVENTION

Figure 1B:
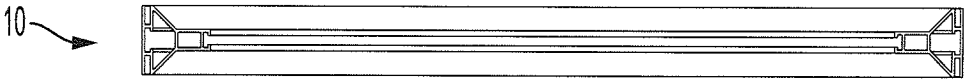
FIG. 1 shows multiple views of a channel member: (a) is an end view; (b) is a top view; (c) is a side view; (d) is a perspective view.
Figure 1D:
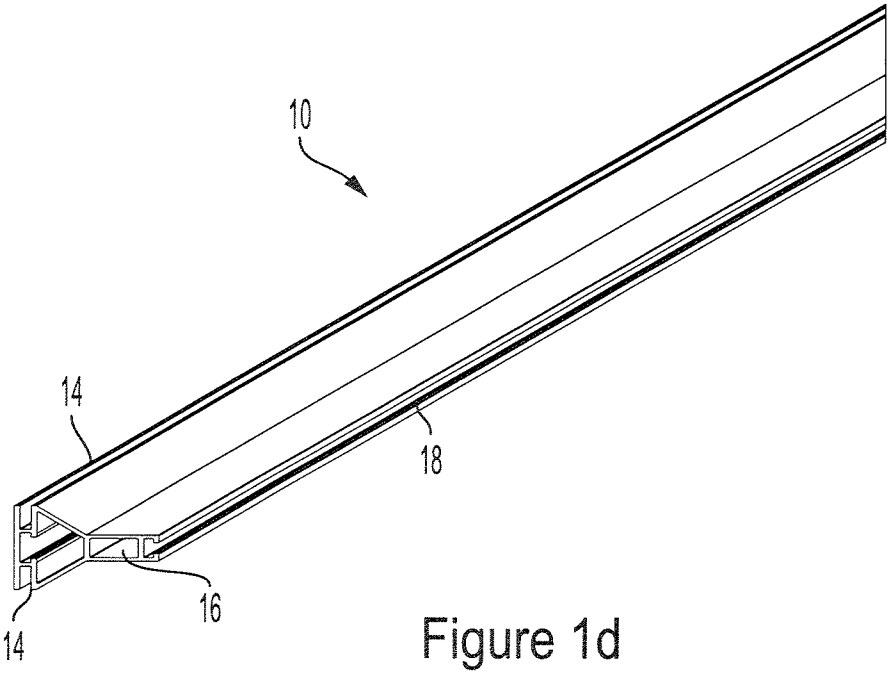
Figure 1C:
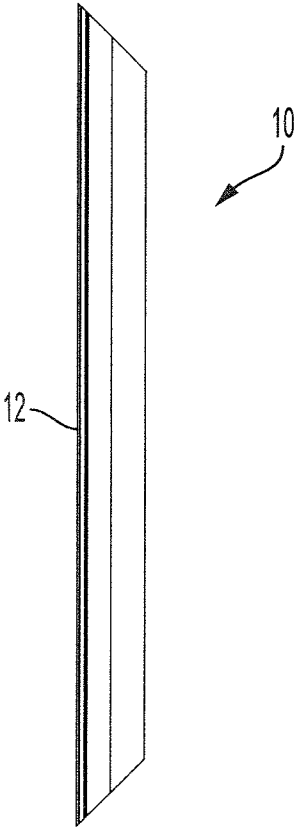
Figure 1A:
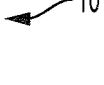

In the Figures, a frame system 8 for SEG graphics is shown. FIG. 1 shows multiple views of the perimeter frame member 10 of the system, including an end view (upper left), an inside view (upper right) showing the frame member 10 as it would appear from the inside of the frame looking out, a side view (lower left), and a perspective view (lower right). The frame member 10 has a flat outside edge 12, and two opposing gasket/bead channels 14, a corner bracket channel 16, and a hardware connector channel 18. Generally, four frame members 10 are used to create an enclosure of a square or rectangular shape.

The SEG graphic bead edge press fits into the U-shaped gasket channels 14. Thus, the frame system can accommodate one or two SEG graphics, wherein a graphic can be inserted into one or both gasket channels 14 to create a wide arrange of display options.

The frame members 10 are joined together at the diagonally shaped corners with L-shaped corner brackets 20 that fit into the corner bracket channels 16. One corner bracket 20 joins the ends of two frame members 10, and four corner brackets 20 are used to create an enclosure (see FIG. 2).

The frame members 10 include an inward facing hardware channel 18, which can be used for various purposes including attaching sliders and braces, as described below.

The frame member 10 profile as seen from the end view of FIG. 1, having a number of bends and diagonal portions, has the advantage of not only providing channels for the various purposes described herein but the shape substantially increases the strength of the frame members 10 and their ability to withstand bending forces exerted by the graphic.

Figure 2C:
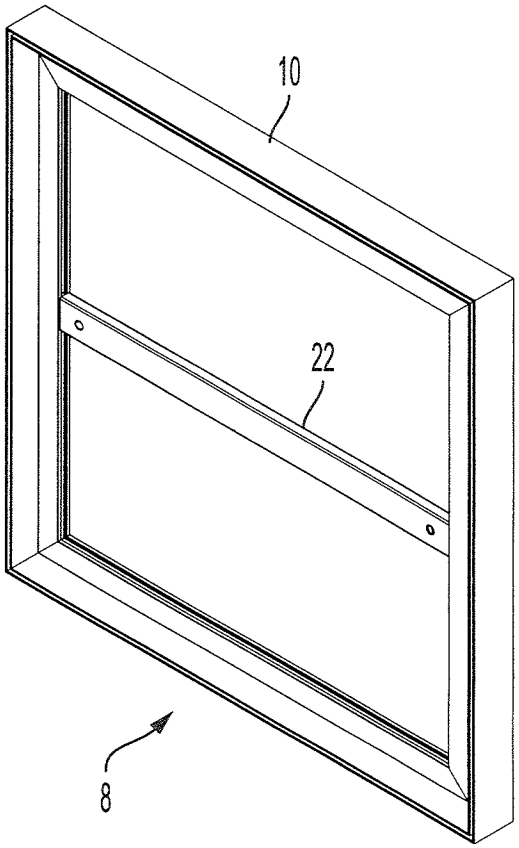
FIG. 2 shows multiple views of a frame system: (a) is an end view; (b) is a side view; (c) is a perspective view.
Figure 2A:
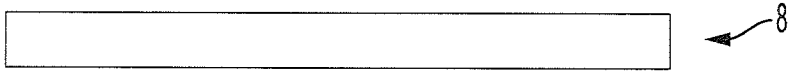
Figure 2B:
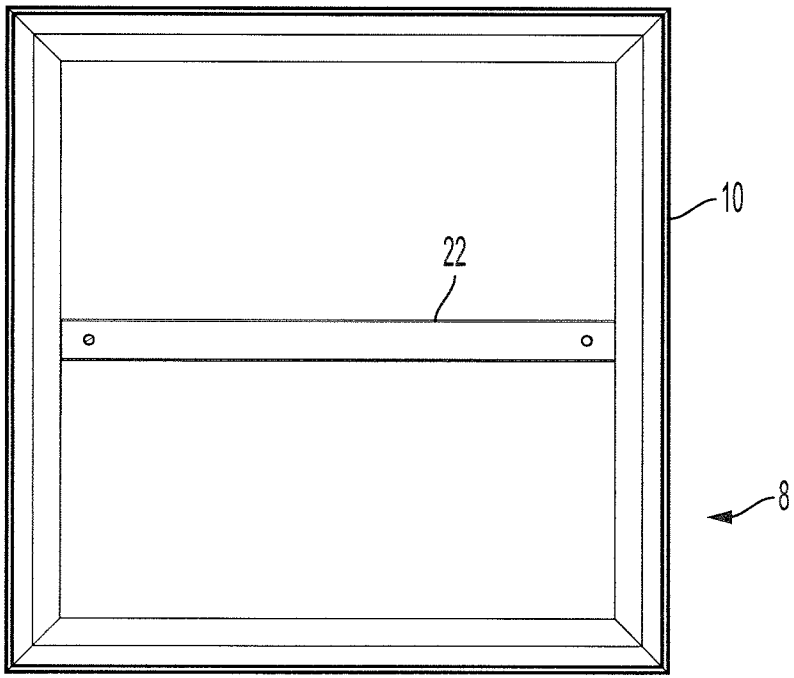

FIG. 2 shows a frame system 8 of the present invention. In this embodiment the frame is relatively small, and is comprised of four frame members 10 joined together to form a square using the corner brackets 20. A center brace 22 is added to provide structural support to prevent the frame from bending under the tension of the SEG graphic. The center brace 22 can attach to the frame members 10 by sliding into the hardware channel 18 through the use of a slider 24 as described below (alternatively the center brace 22 can be modified to include a foot that will fit into the hardware channel 18). This configuration is ideal for relatively small frames that only need a moderate amount of support. In some cases, for smaller frames, center braces 22 may not be needed.

Figure 3:
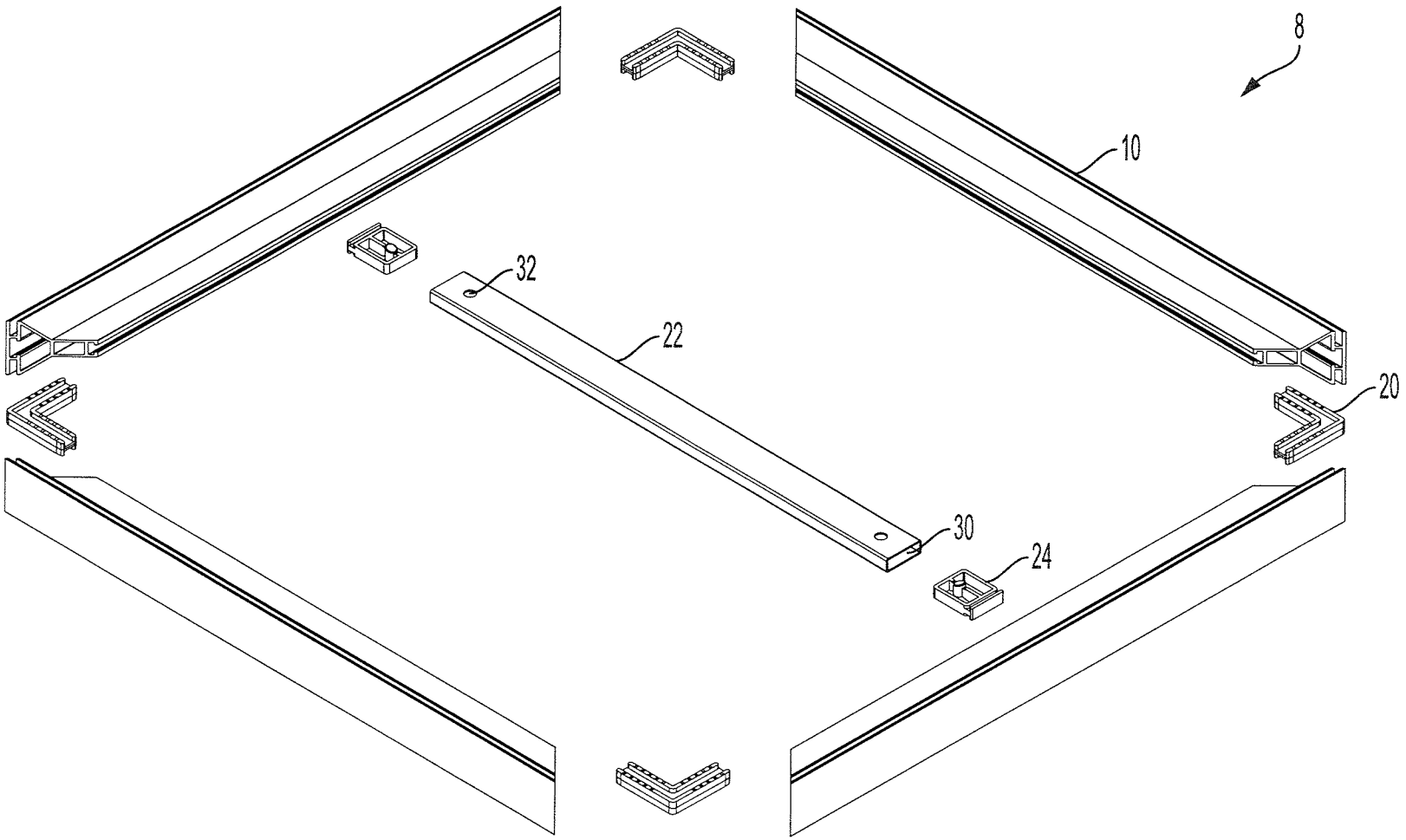
FIG. 3 shows a deconstructed perspective view of the frame system of FIG. 2.

FIG. 3 is a deconstructed view of the frame system 8 of FIG. 2. The system comprises four frame members 10, four L-shaped corner brackets 20, a support brace 22, and two sliders 24. The system 8 is assembled by inserting a foot 26 of the sliders 24 (see FIG. 11) into the hardware channel 18. Then the slider 24 has a raised button 28 that snap fits into holes 32 near the ends of the center brace 22 for a secure connection therewith. The end of the slider 24 opposite the foot 26 fits into a cavity 30 in the end of the center brace 22, and pressed therein will snap into locked engagement with the center brace 22. Next, the frame members 10 are connected using the L-Shaped corner brackets 20. The corner brackets 20 have small barbs 34 (see FIG. 12) that pressure fit against the sides of the corner bracket channel 16 so they do not come lose once inserted therein. The barbs 34 are angled to allow for easier insertion into the corner bracket channel 16, and harder removal therefrom.

Figure 4A:
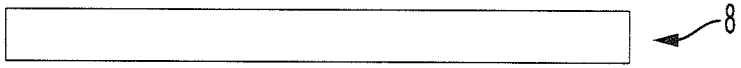
FIG. 4 shows multiple views of a frame system: (a) is an end view; (b) is a side view; (c) is a perspective view.
Figure 4B:
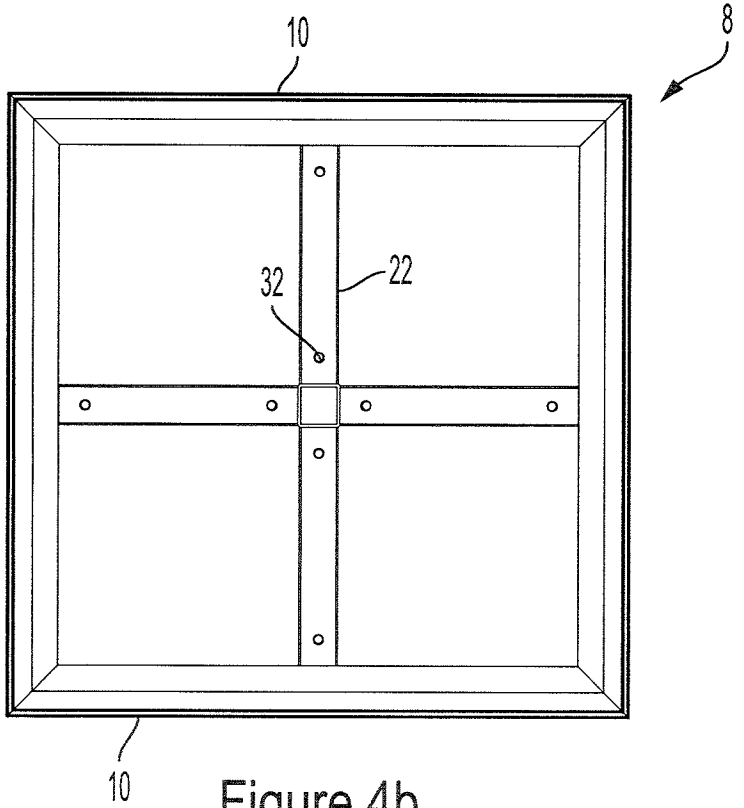
Figure 4C:
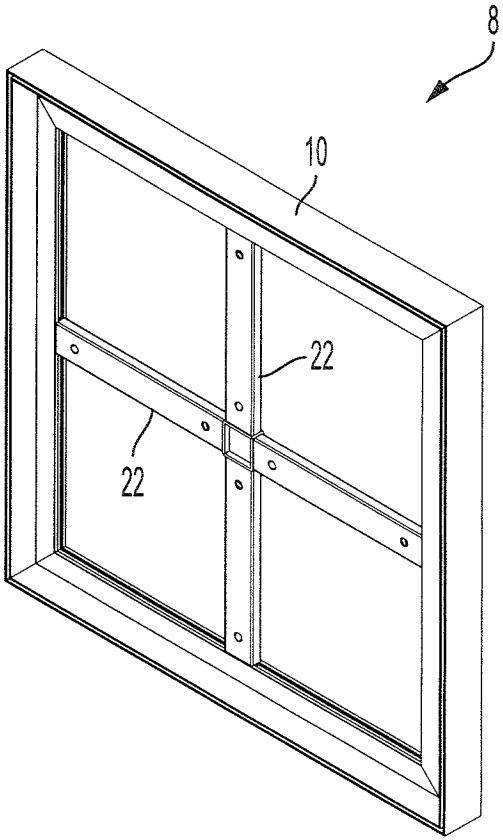
Figure 5:
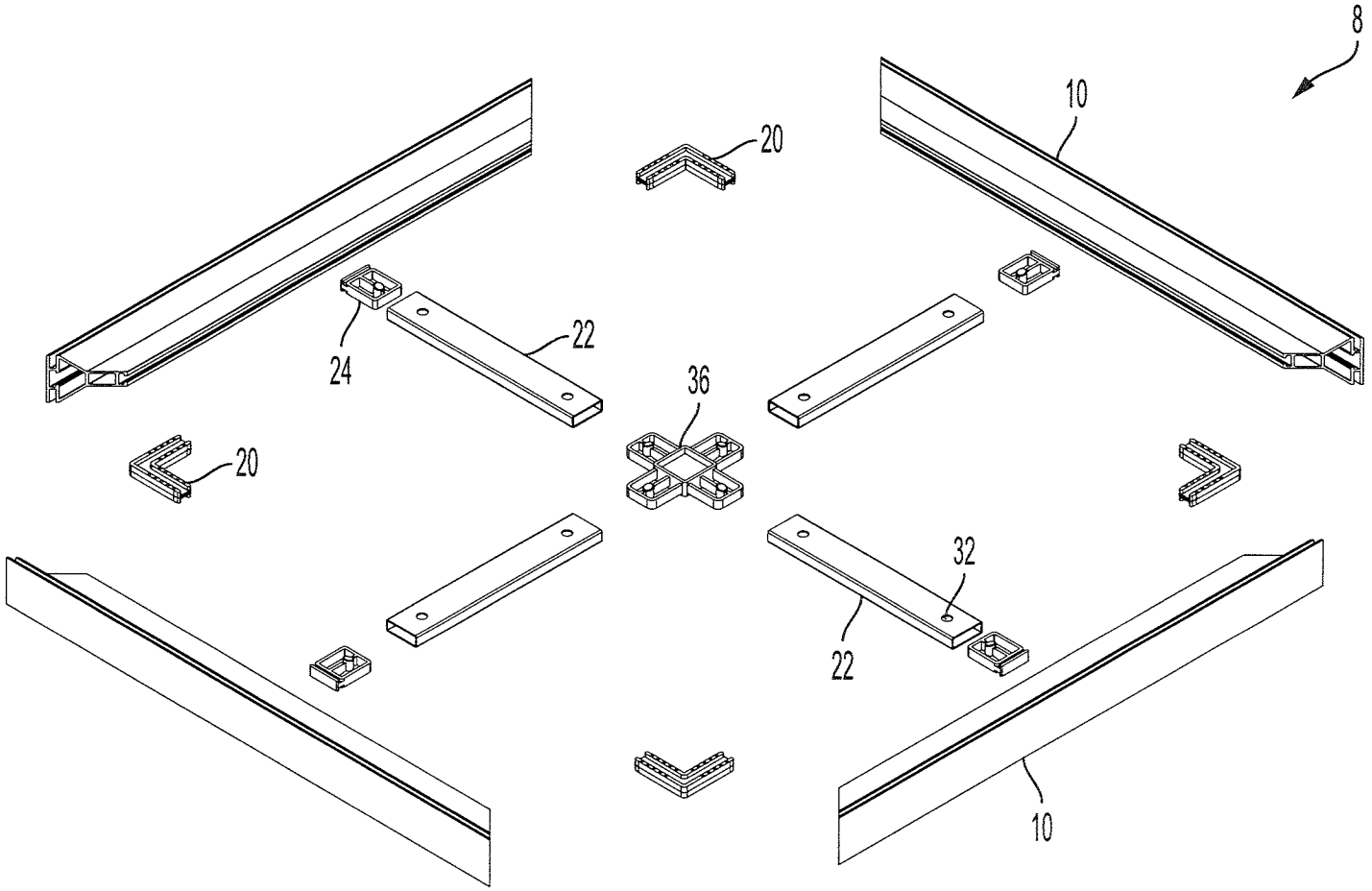
FIG. 5 shows a deconstructed perspective view of the frame system of FIG. 4.
Figure 6B:
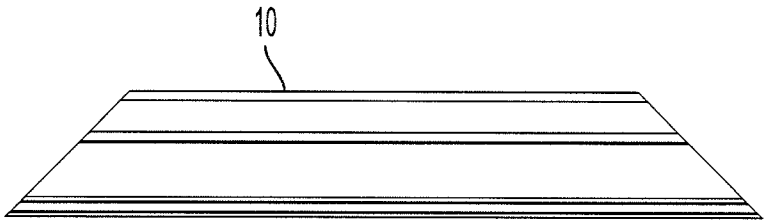
FIG. 6 shows multiple views of a channel member: (a) is an end view; (b) is a top view; (c) is a side view; (d) is a perspective view.
Figure 6D:
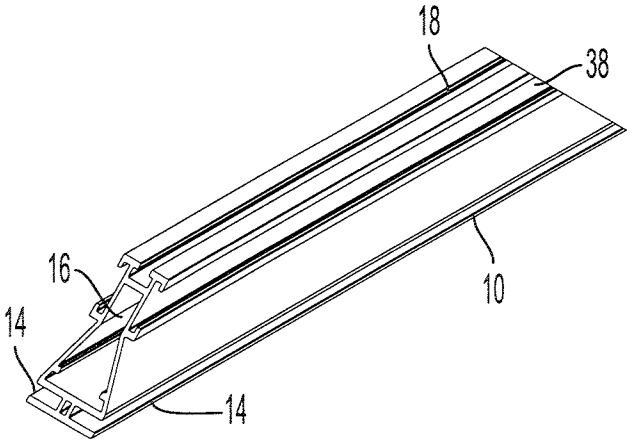
Figure 6C:
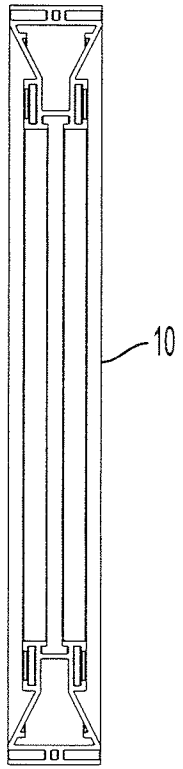
Figure 6A:
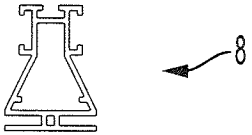

FIGS. 4 and 5 show a larger frame system 8 that uses four center braces 22 to provide additional structural support. The center braces 22 attach to the frame members 10 as described above. The center braces 22 are connected to each other in the center with a four-way connector 36 (see FIG. 10). The ends of the four-way connector 36 slide into cavities 30 at the ends of the center braces 22 and snap fit in place when a button 28 on each end of the connector fits into holes 32 in the center braces 22.

As noted the profile of the frame member 10 is significant not only to create the various channels, but also to create strength to resist bending forces. Preferably, the frame members 10 (and the other parts) are made of a hard plastic material such as Polycarbonate or PVC or other similar materials. The frame member 10 can be extruded and then cut to length as needed. In this manner, the frame members 10 can be constructed from relatively low cost material, and the frame system will still provide more than ample strength. This also reduces the complexity of manufacturing.

FIG. 6 shows various views of the frame member 10, with an alternative corner bracket channel 16, having a side channel 38 and a more open corner channel.

Figure 7C:
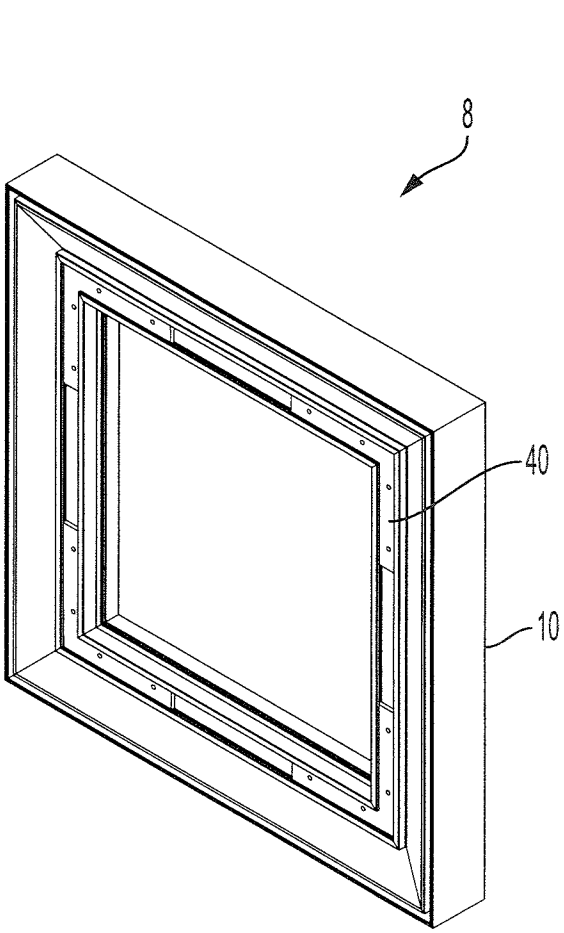
FIG. 7 shows multiple views of a frame system: (a) is an end view; (b) is a side view; (c) is a perspective view.
Figure 7A:
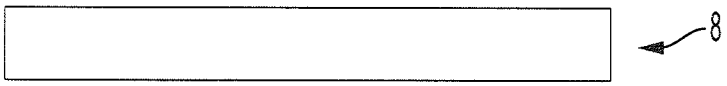
Figure 7B:
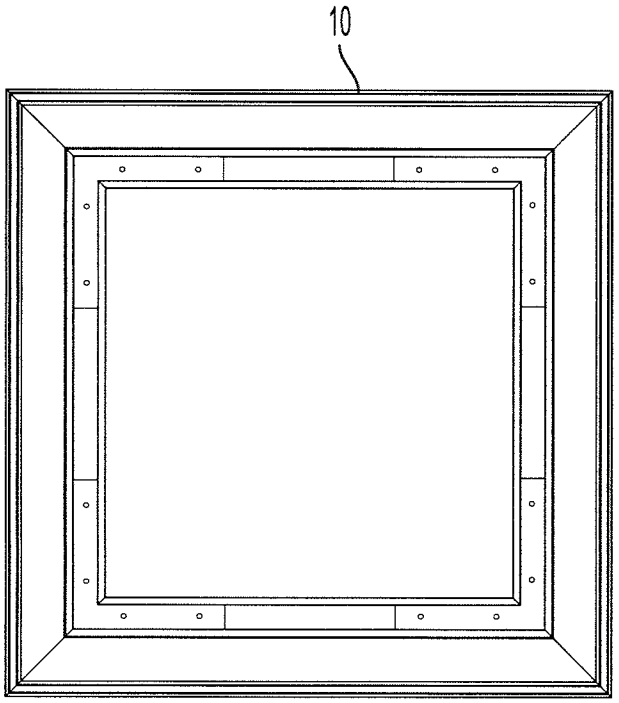
Figure 14A:
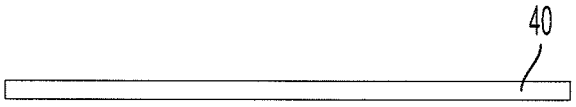
FIG. 14 shows multiple views of an L-connector: (a) is an end view; (b) is a side view; (c) is a perspective view.
Figure 14B:
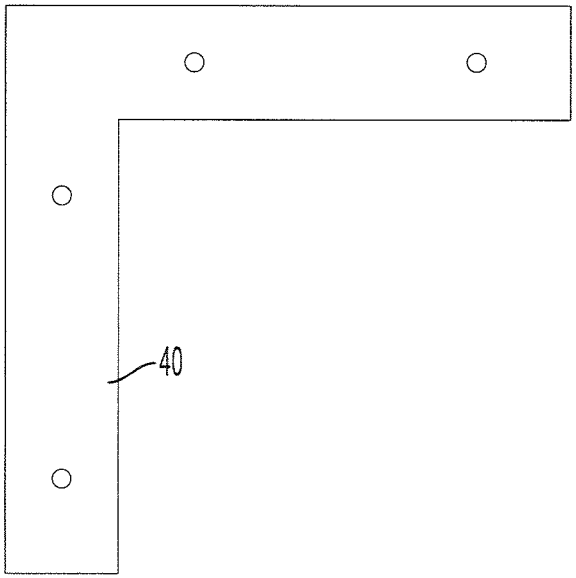
Figure 14C:
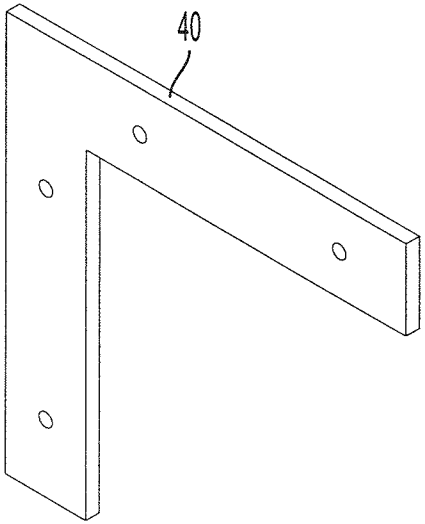

FIG. 7 shows frame system 8 that is comprised of the four frame members 10 show in in FIG. 6, and is of a size that does not require center braces 22 or supports therebetween, but uses screw tensioned L-shaped corner brackets 40 (see FIG. 14). The L-shaped corner brackets 40 slide into the side channels 38 on the side of the frame members 10, instead of into the corner bracket channel 16 located inside the frame members 10 as described in reference to the frame members 10 shown in FIG. 1. Metal screws can then secure the L-shaped corner brackets 40 to the frame members 10, and/or to each other.

Figure 8:
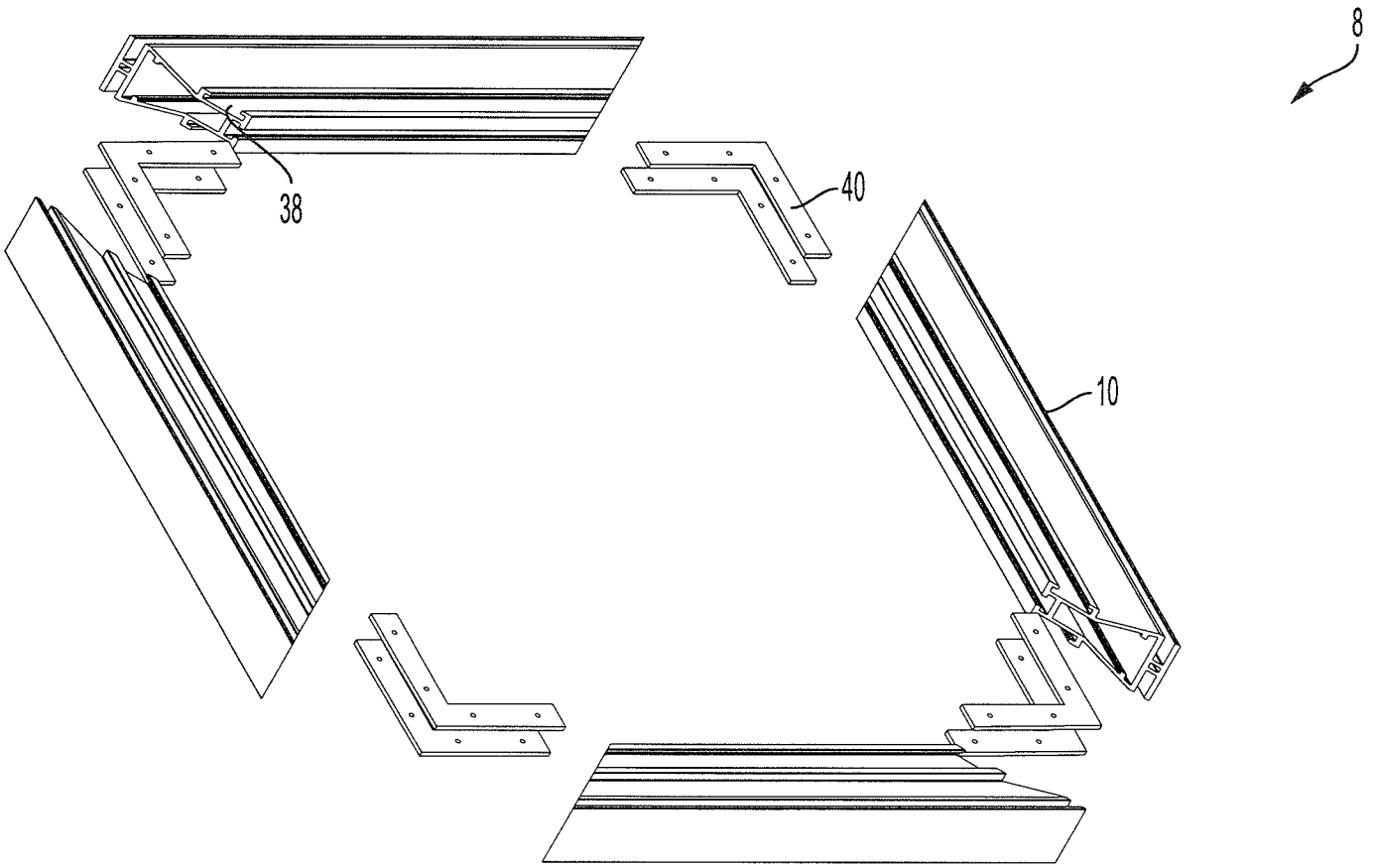
FIG. 8 shows a deconstructed perspective view of the frame system of FIG. 7.

As seen FIG. 8, a total of 8 L-shaped corner brackets 40 (two for each corner) secure into the side channels 38 of the frame members 10 and are then held in place with screws that connect the L-shaped corner brackets 40 to the frame members 10. The screws can be tensioned to the desired amount, allowing for control over how tight the frame system fits.

Figure 9C:
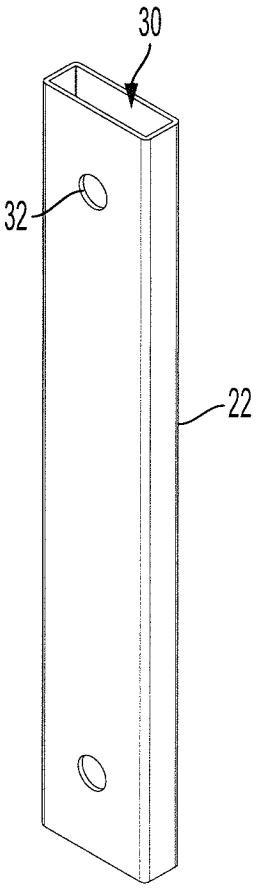
FIG. 9 shows multiple views of a support brace: (a) is an end view; (b) is a side view; (c) is a perspective view.
Figure 9B:
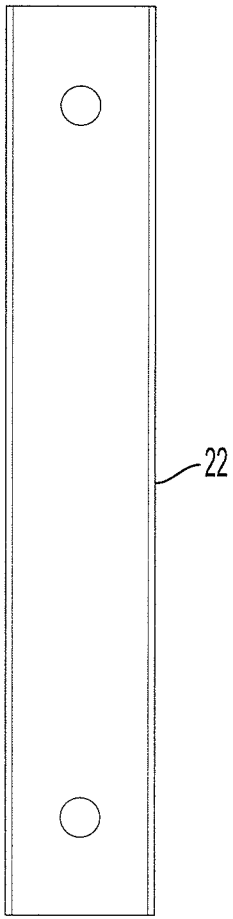
Figure 9A:
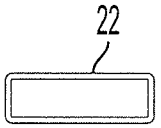

FIG. 9 shows various views of the center brace 22. The center brace 22 has a hollow cavity 30 to allow for insertion of the four-way connectors 36 and sliders 24, and include a hole 32 to allow the four-way connectors 36 and sliders 24 to snap fit together.

Figure 10A:
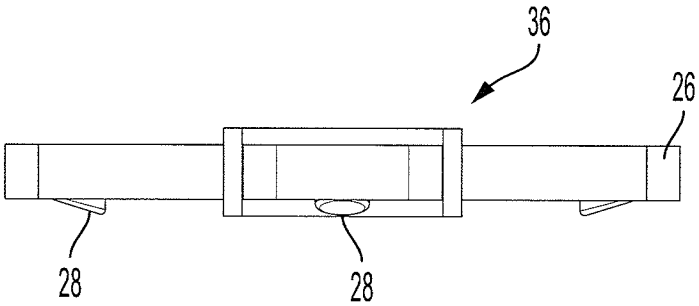
FIG. 10 shows multiple views of a four-way connector: (a) is an end view; (b) is a side view; (c) is a perspective view.
Figure 10B:
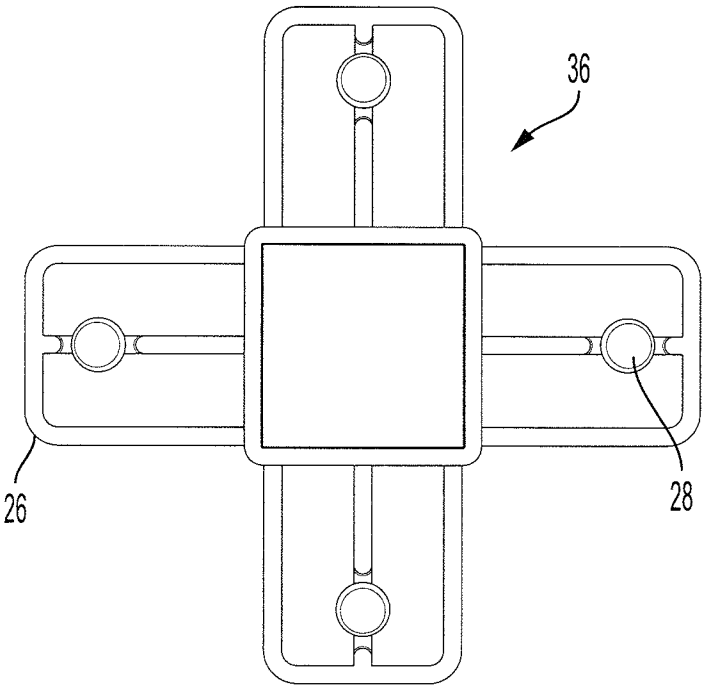
Figure 10C:
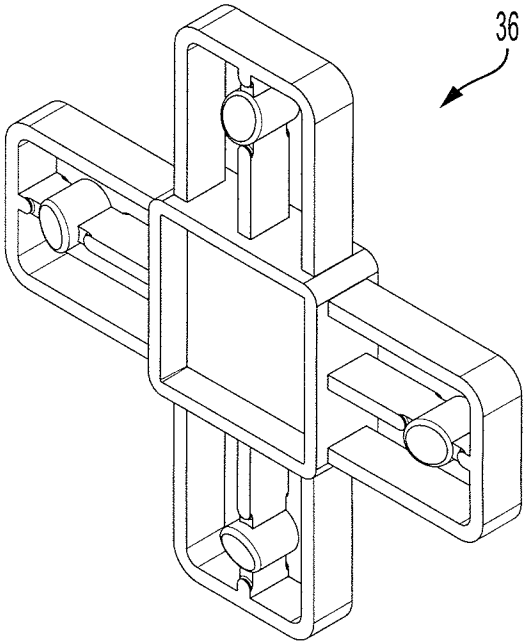
Figure 11D:
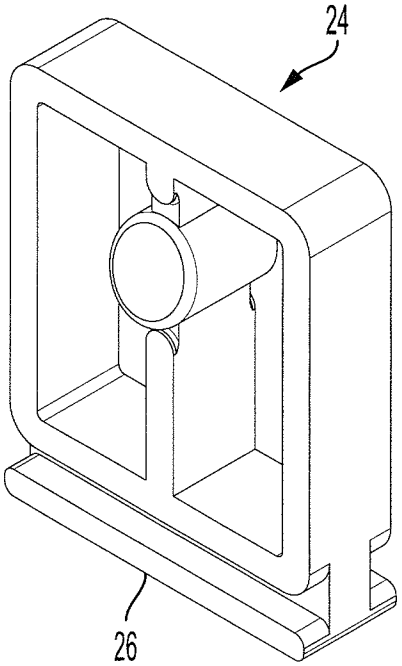
FIG. 11 shows multiple views of a slider: (a) is a first end view; (b) is a side view; (c) is a second end view; (d) is a perspective view.
Figure 11C:
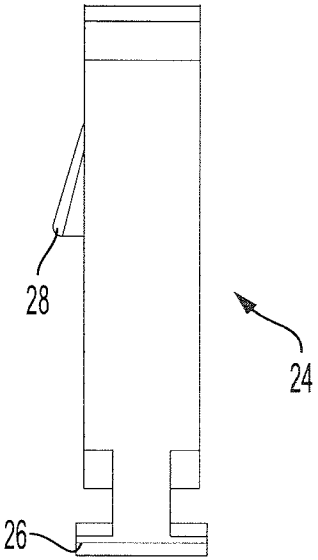
Figure 11A:
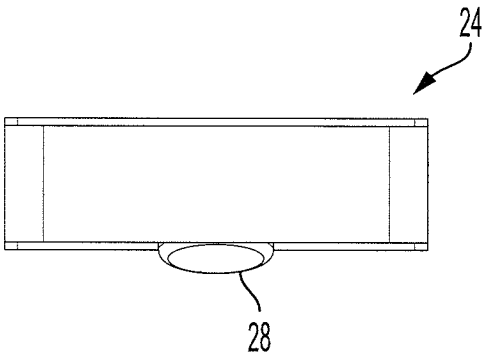
Figure 11B:
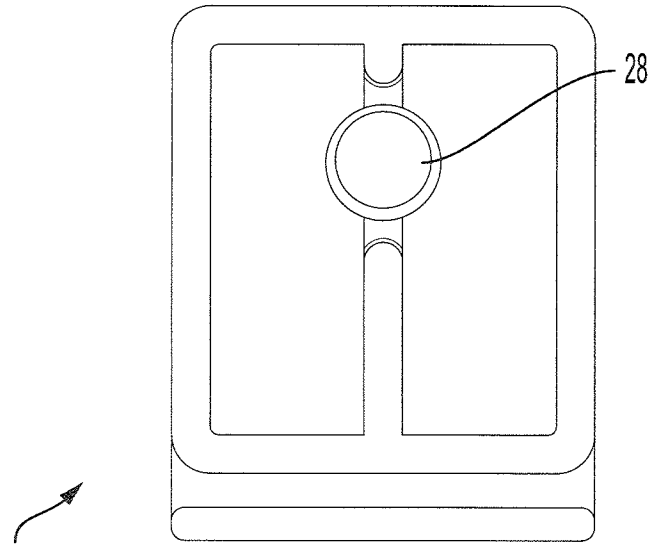

FIG. 10 shows in detail the four-way connector 36, which is used to join together the center braces 22. The four-way connector 36 includes four feet 26 that fit into cavities 30 at the end of the center braces 22, and a raised button 28 that snap fits into holes 32 in the end of the center braces 22. As can be seen the buttons 28 are tapered so that the lower end goes into the center brace cavity 30 first and the higher trailing end then snaps in place to better prevent the four-way connector 36 from coming loose.

FIG. 11 shows in detail the slider 24. The slider 24 includes a foot 26 that mates with the hardware channel 18 in the frame members 10, and the end opposite the foot 26 that can be inserted into the cavity 30 at the end of the center brace 22. A raised button 28 snap fits into a hole 32 in the center brace 22. As can be seen the buttons 28 are tapered so that the lower end goes into the center brace 22 cavity 30 first and the higher trailing end then snaps in place.

Figure 12C:
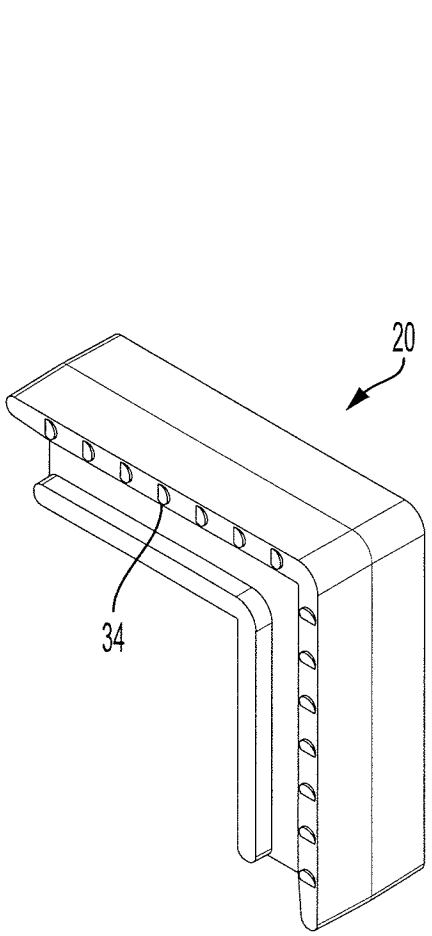
FIG. 12 shows multiple views of a corner bracket: (a) is an end view; (b) is a side view; (c) is a perspective view.
Figure 12A:
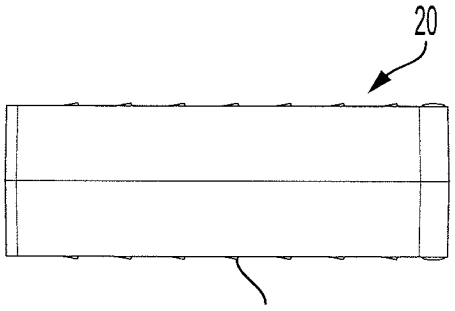
Figure 12B:
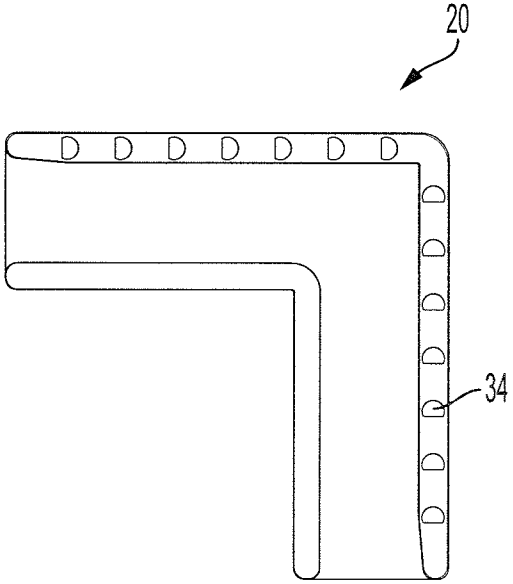

FIG. 12 shows the corner bracket 20 that inserts into the corner bracket channel 16 of the frame members 10 shown in FIG. 1. The corner bracket 20 includes barbs 34 that pressure fit against the sides of the corner bracket channel 16 to ensure a secure fit therein.

Figure 13A:
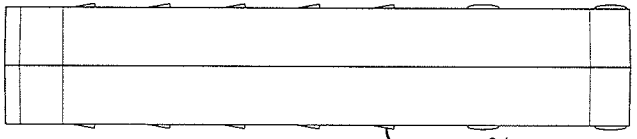
FIG. 13 shows multiple views of an alternative corner bracket: (a) is an end view; (b) is a side view; (c) is a perspective view.
Figure 13C:
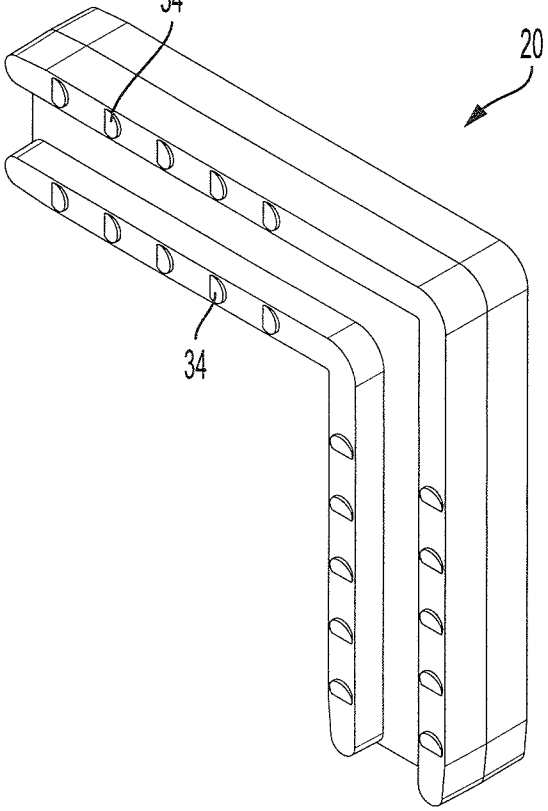
Figure 13B:
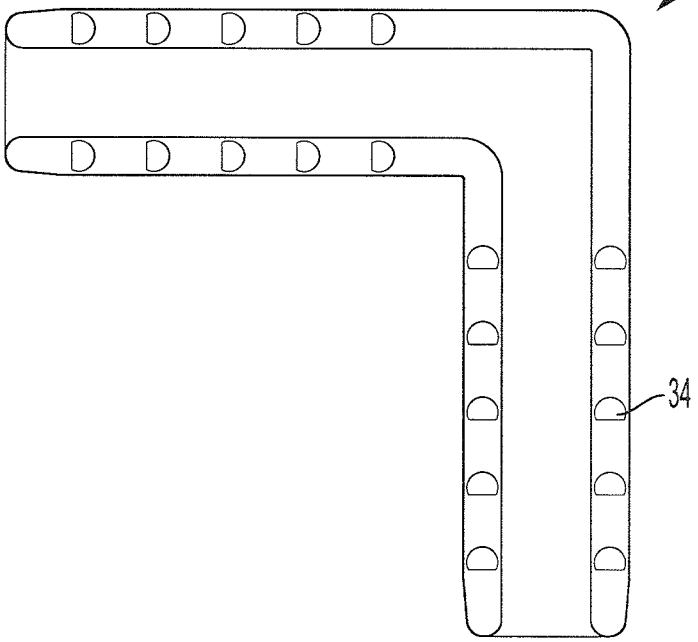

FIG. 13 shows an alternative corner bracket 20 that includes two sets of barbs 34 on each side for an even more secure fit within the frame members 10.

FIG. 14 shows the L-shaped corner brackets 40 used with the frame members 10 shown in FIG. 8, which use screws to attach thereto.

Figure 15C:
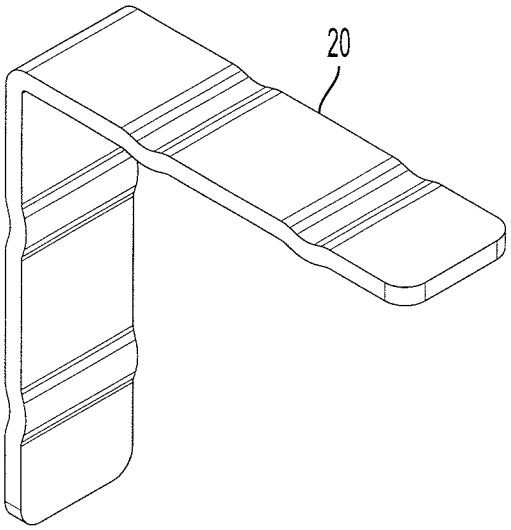
FIG. 15 shows multiple views of a second alternative corner bracket: (a) is an end view; (b) is a side view; (c) is a perspective view.
Figure 15A:
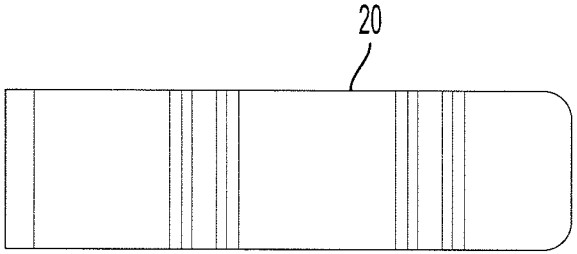
Figure 15B:
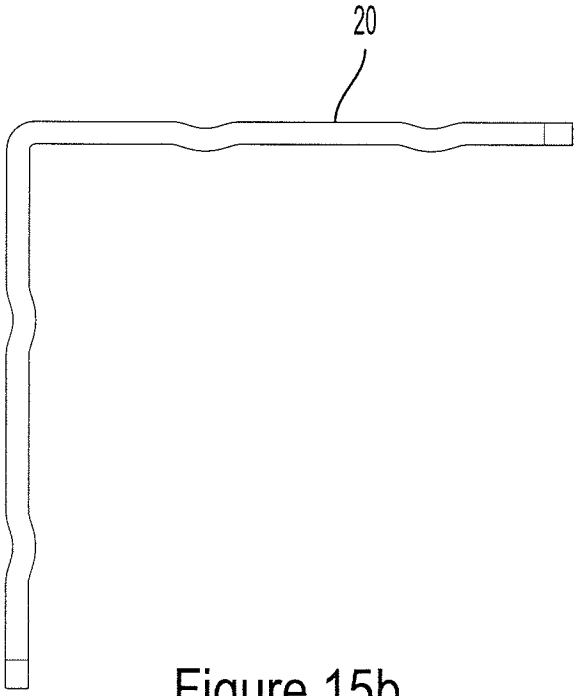

FIG. 15 shows yet another corner bracket 20 that includes indents and ridges that can fit snuggly against the inside of the corner bracket channel 16 to provide for a secure fit within the frame members 10.

Figure 16C:
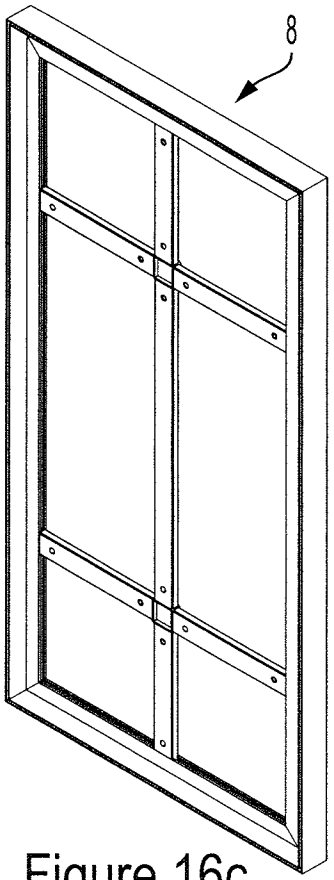
FIG. 16 shows multiple views of a frame system: (a) is an end view; (b) is a side view; (c) is a perspective view.
Figure 16B:
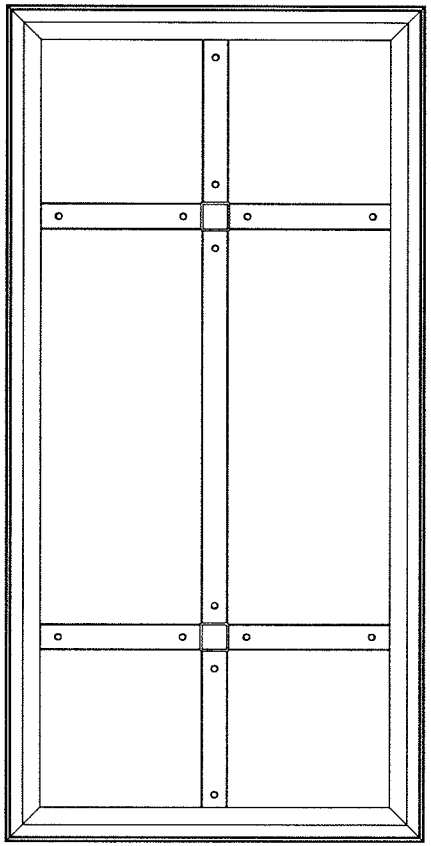
Figure 16A:
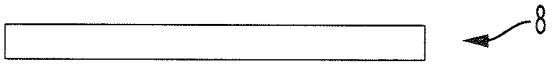

FIG. 16 shows a larger frame system 8 that includes multiple four-way connectors 36 used to provide additional bracing for large size frames.

Figure 17:
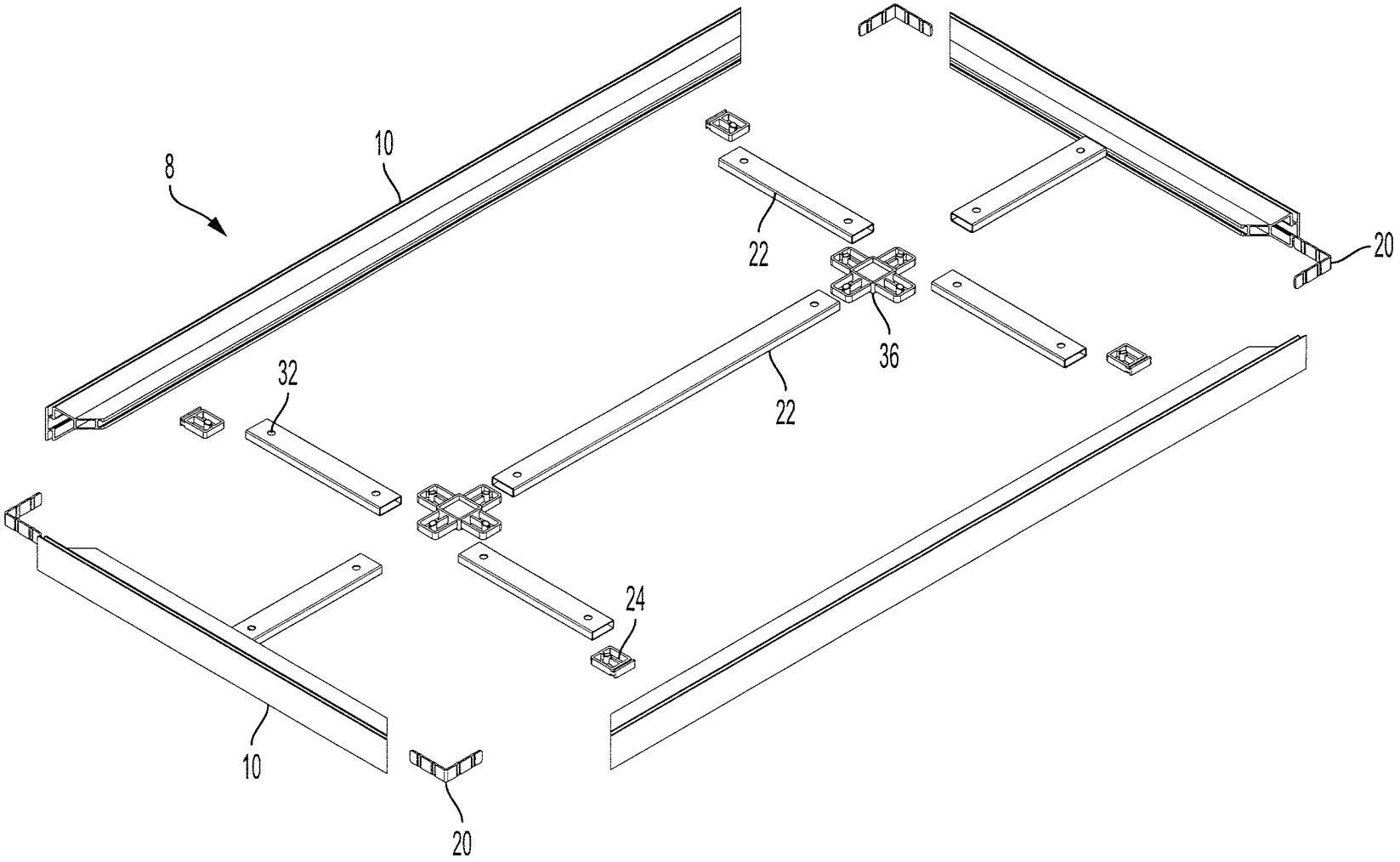
FIG. 17 shows a deconstructed perspective view of the frame system of FIG. 17.

FIG. 17 shows in detail the components of the large frame system shown in FIG. 16, which includes the corner brackets 20 shown in FIG. 15.

Figure 18:
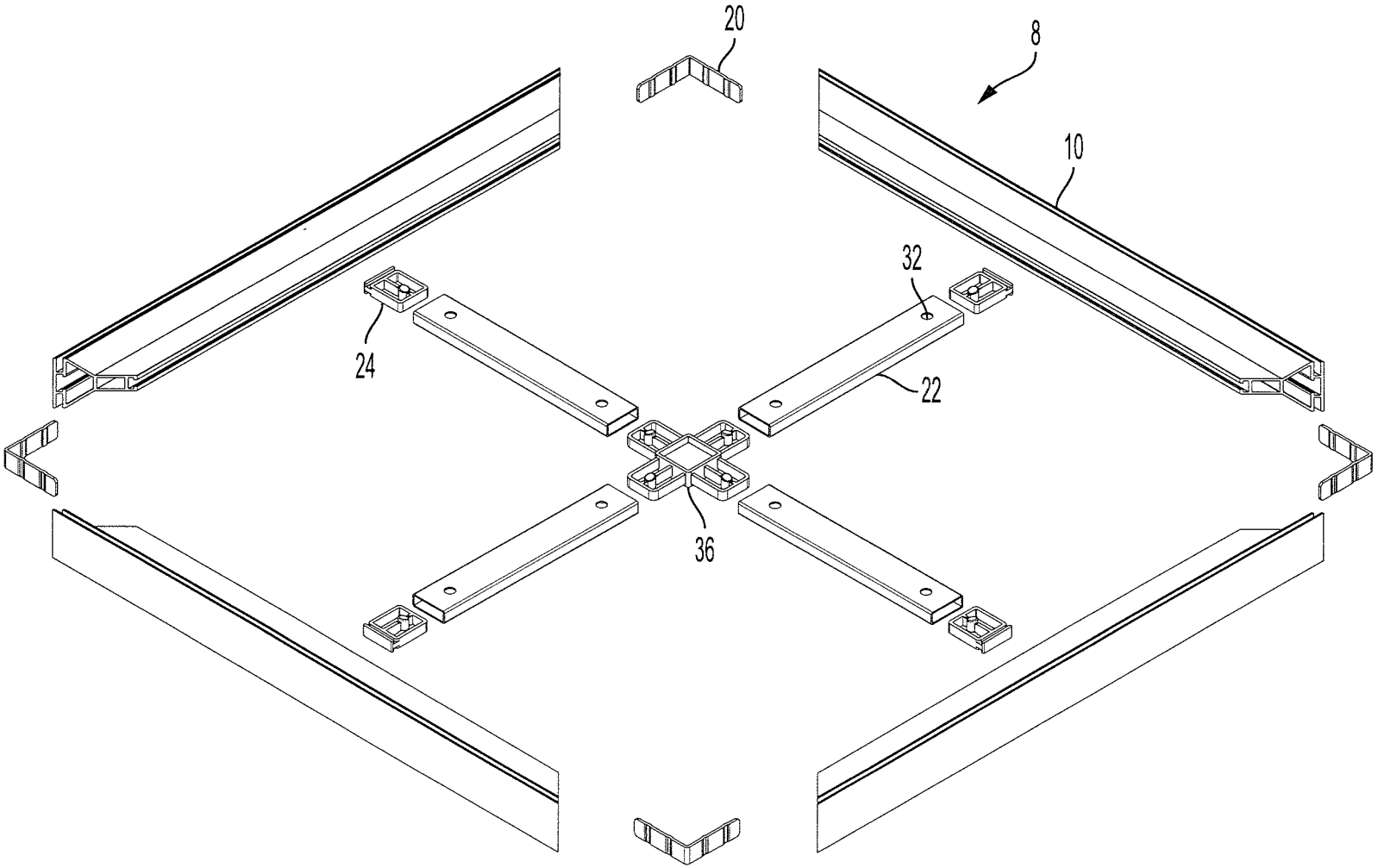
FIG. 18 shows a deconstructed perspective view of a frame system using the corner bracket shown in FIG. 15.
Figure 19D:
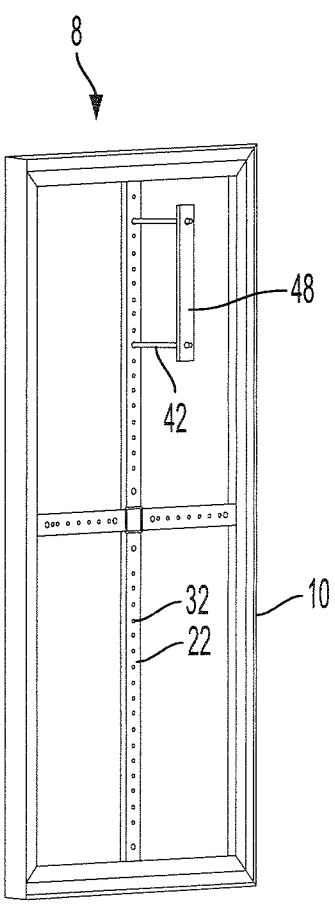
FIG. 19 shows multiple views of a frame system: (a) is an end view; (b) is a side view; (c) is a second end view; (d) shows a perspective view.
Figure 19C:
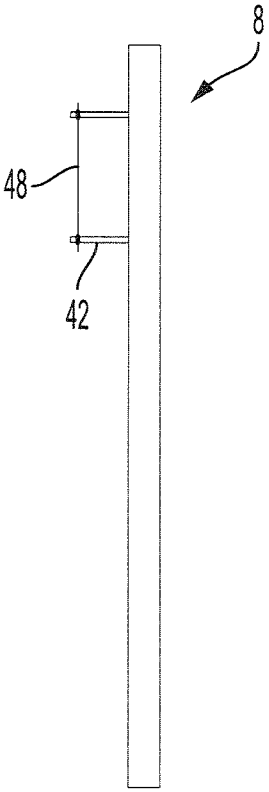
Figure 19B:
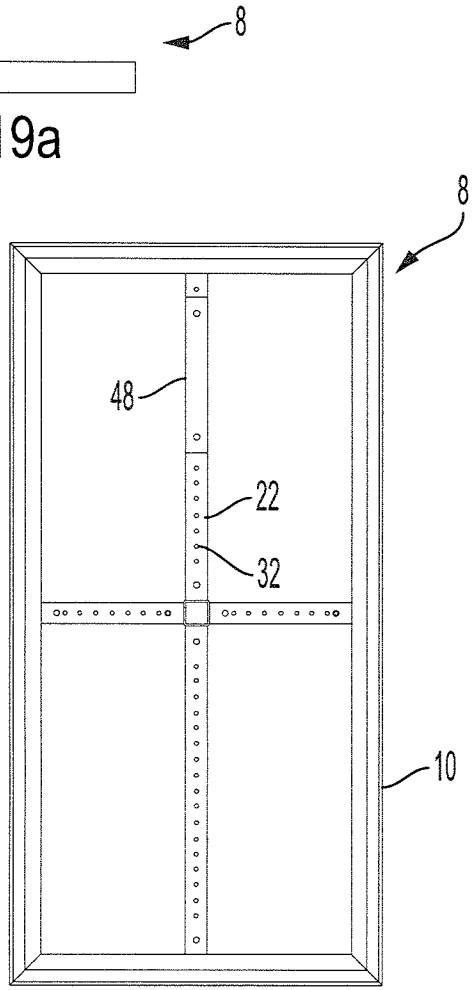
Figure 19A:
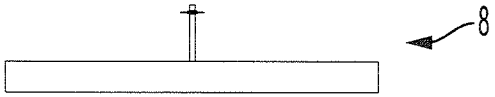

FIG. 18 shows in detail the components of a frame system using the brackets shown in FIG. 15, but only one four-way connector 36.

Figure 20:
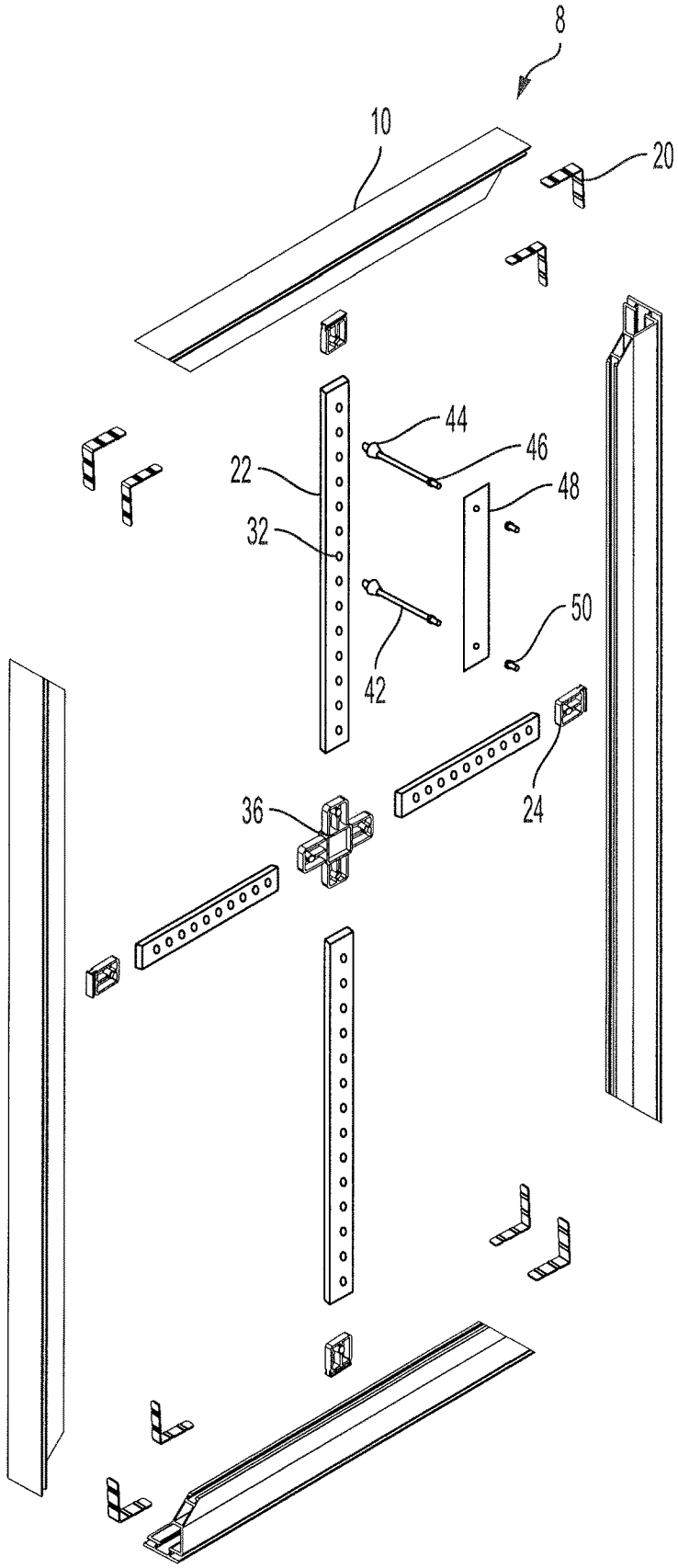
FIG. 20 shows a deconstructed perspective view of the frame system of FIG. 19.

An alternative embodiment is shown starting in FIG. 19. FIG. 19 shows multiple views of a frame system 8 with four center braces 22 configured as described above. The center braces 22 have regularly spaced apart holes 32 along them on both sides. One or more posts 42 connects to the holes 32 in the center brace 22. The posts 42 have a threaded end that engages the holes 32. The other end of the post has a flange 44, and above the flange a threaded head 46. The flange 44 acts as a stop to support a panel 48. The panel 48 can then be attached to the posts 42 by fitting holes in the panel 48 over the threaded head 46 and securing a threaded cap 50 to the head 46. FIG. 20 shows an exploded diagram of the configuration in FIG. 19.

Figure 21:
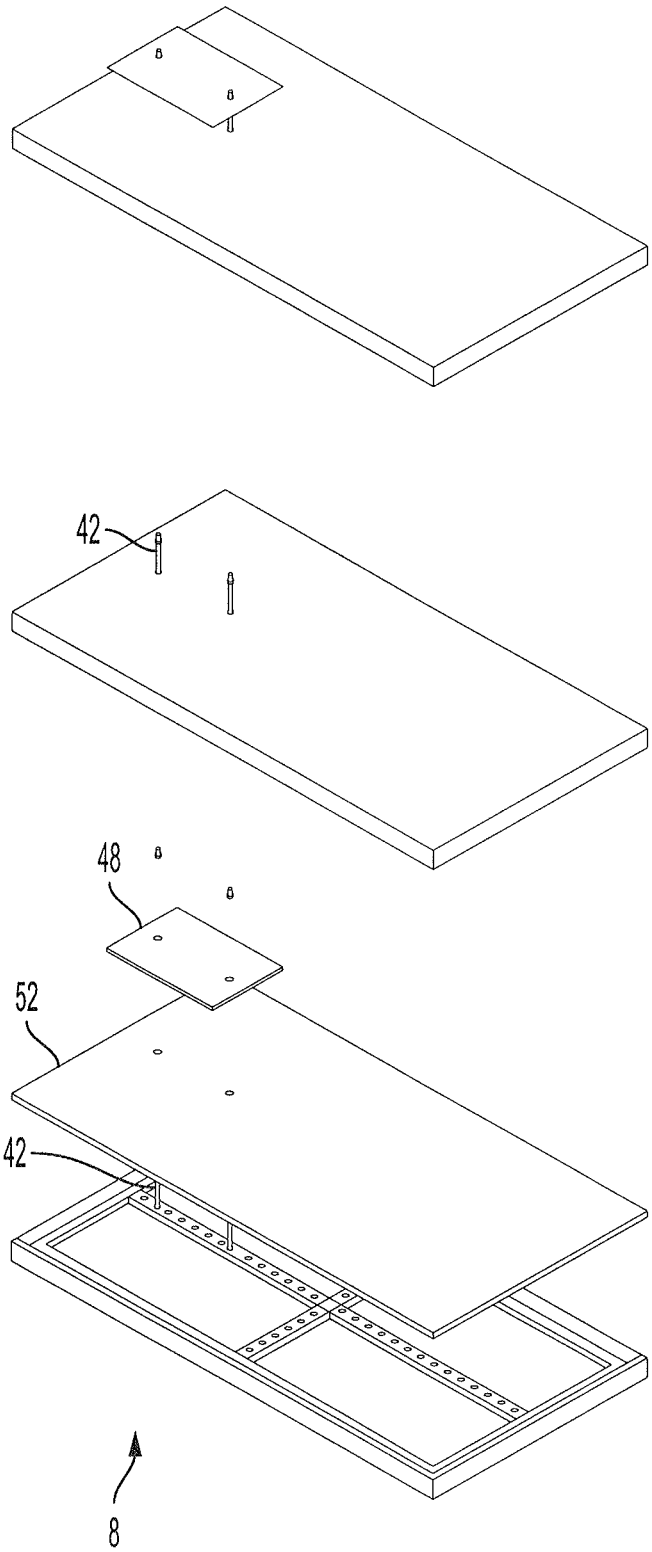
FIG. 21 shows another deconstructed perspective view of the frame system of FIG. 19.

As seen in FIG. 21, an SEG graphic 52 can be fitted over the frame system 8 and the edge bead inserted as described above. Small holes or cuts 32 in the SEG graphic 52, preferably laser cuts, allow the posts 42 to extend through the SEG graphic 52, and then the panel 48 can be secured as described above. This allows for creating dimensional displays above the SEG, or that interact with the SEG, and which can be easily replaced. Posts 42 can be connected to multiple braces, to allow for the use of multiple panels 48, or larger panels 48. Also, other items can be secured to the post 42 as desired to create graphic effects or to provide descriptive material.

Figure 22:
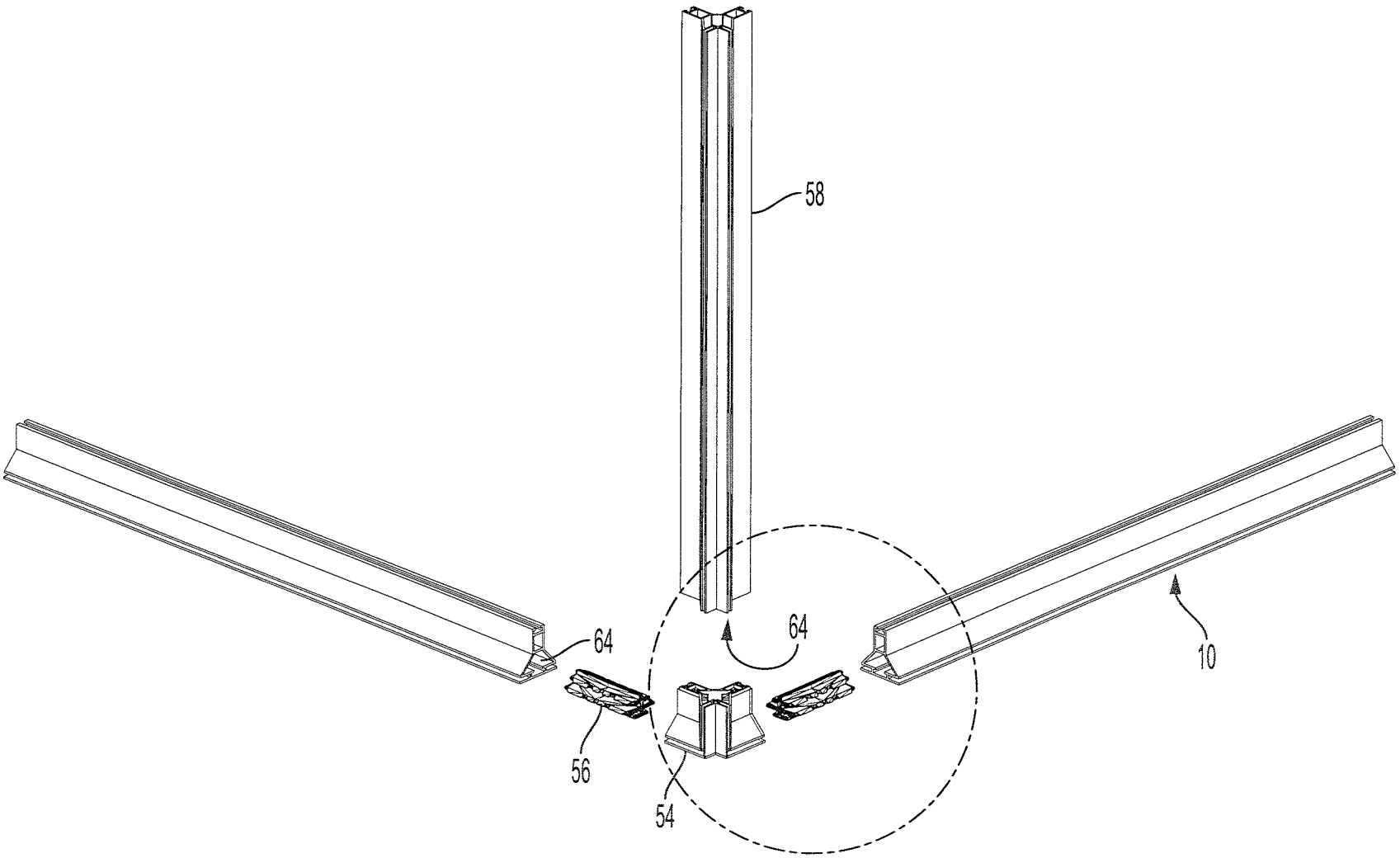
FIG. 22 shows a perspective view of a portion of a frame system with a three-way connector.
Figure 23:
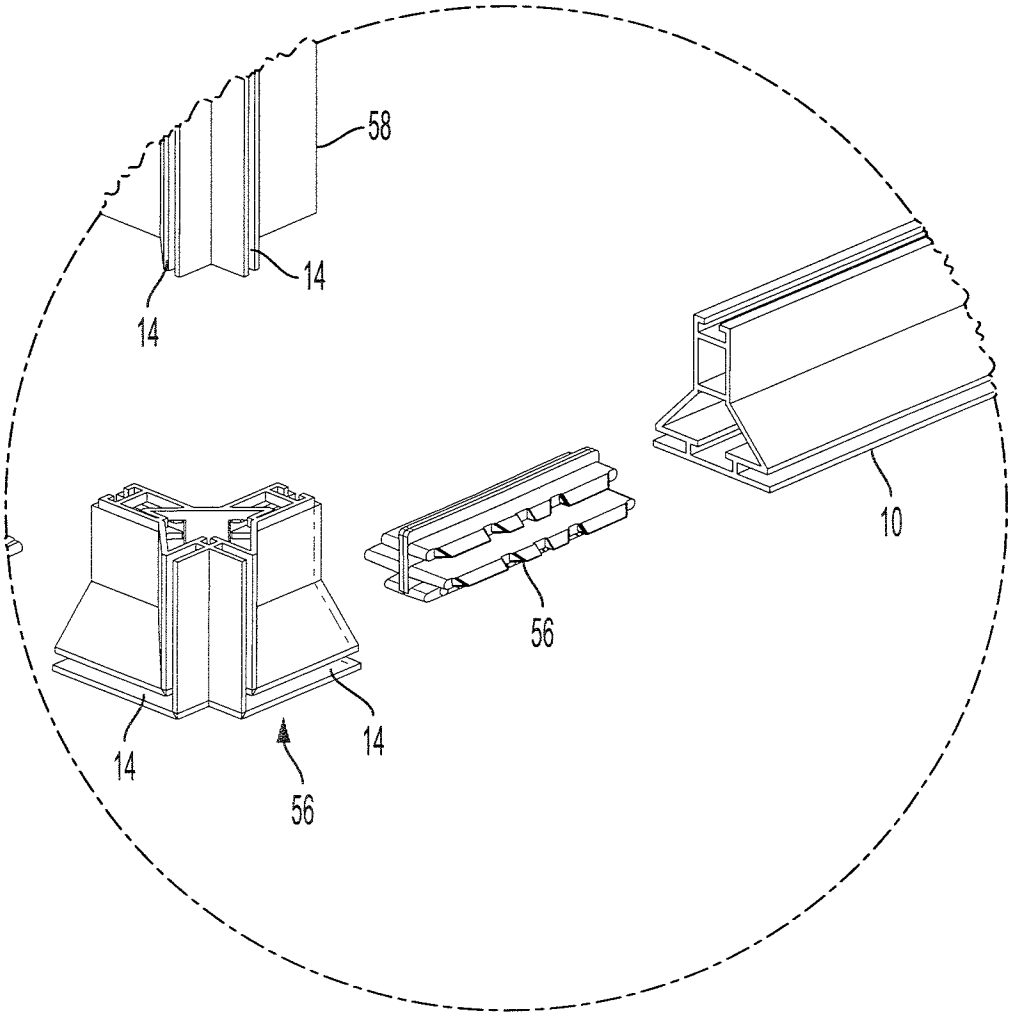
FIG. 23 is a close up view of a portion of the frame system shown in FIG. 22.

FIGS. 22 and 23 shows an additional embodiment of the present invention comprising a three-way bracket 54. The three-way bracket 54 allows for joining two channel members 10 and a modified wedge channel member 58 to create three dimensional shapes, while preserving the ability to place SEG graphics 52 on any surface.

The three-way bracket 54 includes two L-shaped gasket channels 14 on two sides of the three-way bracket 54, and when assembled provides continuity with the gasket channels 14 of the channel members 10, 58. The three-way bracket 54 also maintains the integrity of the hardware channel 18 (see FIG. 24). In particular, the wedge channel member 58 includes two gasket channels 14 aligned at ninety degree angles to each other, to align with the gasket channels 14 of the three-way bracket 54. The side and top profiles of the three-way bracket 54 match that of the channel members 10, 58 that will line up therewith.

A connector 56 secures the channel members 10, 58 to the three-way bracket 54. The connector 56 has a wide center section 60 and two narrow sections 62 connected thereto. The general profile of the connector 56, allows it to fit within a triangular channel 64 of the channel members 10, 58.

Figure 24:
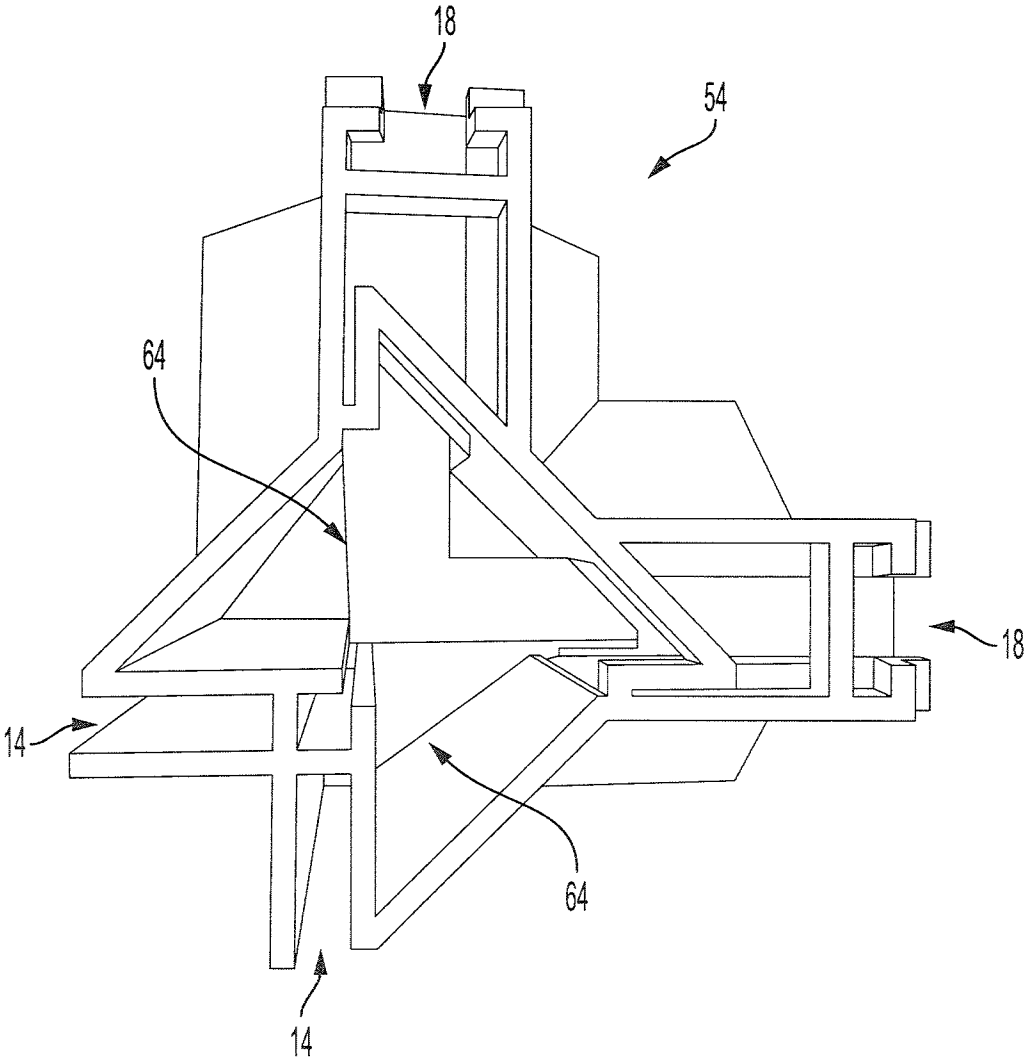
FIG. 24 is a top view of the three-way connector shown in FIGS. 22, 23.
Figure 25:
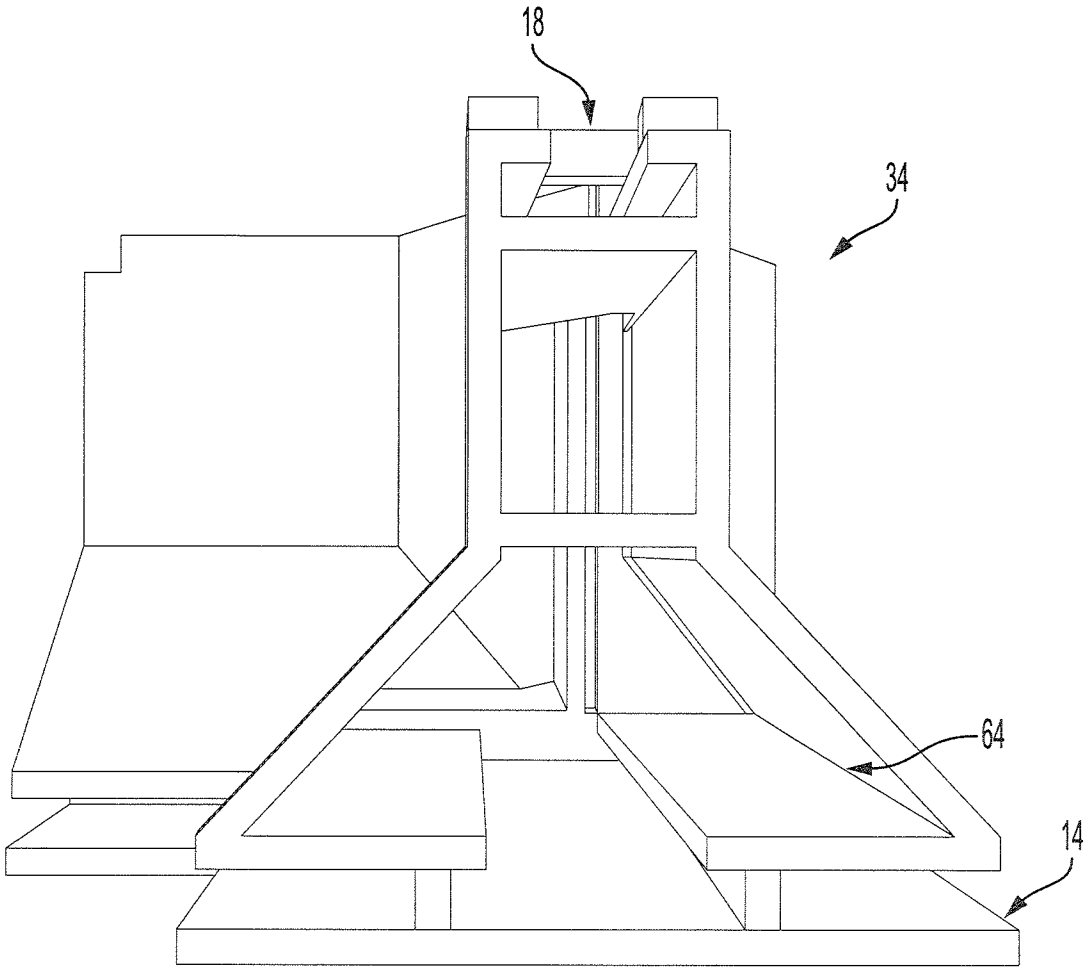
FIG. 25 is a side view of the three-way connector shown in FIGS. 22, 23.
Figure 26:
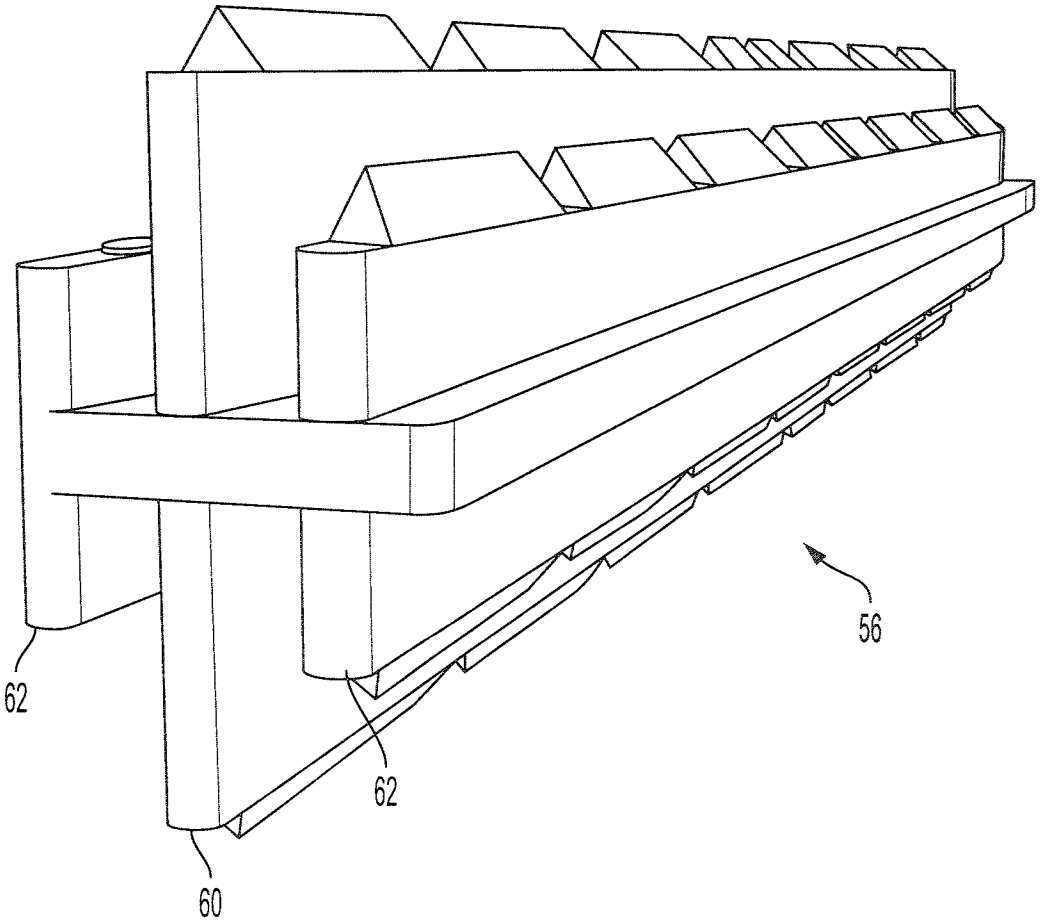
FIG. 26 is a perspective view of connector.

FIG. 24 shows a top view of the three-way bracket 54 and the triangular channel 64, which allows the connector 56 to fit in one of two orientations. FIG. 25 shows a side view of the three-way bracket 54 and the triangular channel 64.

Figure 27B:
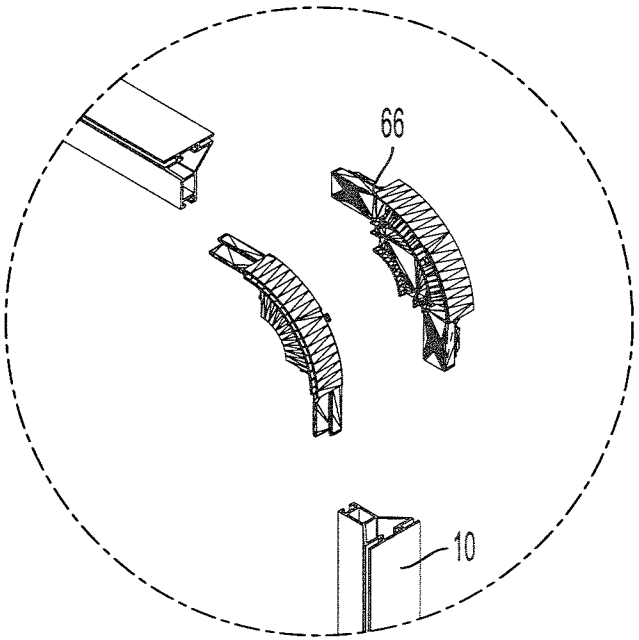
FIG. 27 (a) shows a perspective view of a portion of a frame system with a round connector; (b) shows a close up thereof.
Figure 27A:
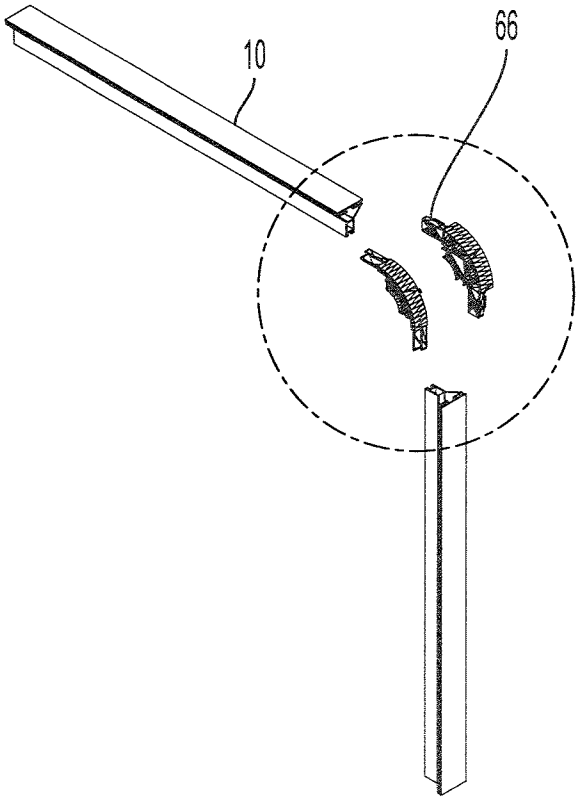
Figure 28:
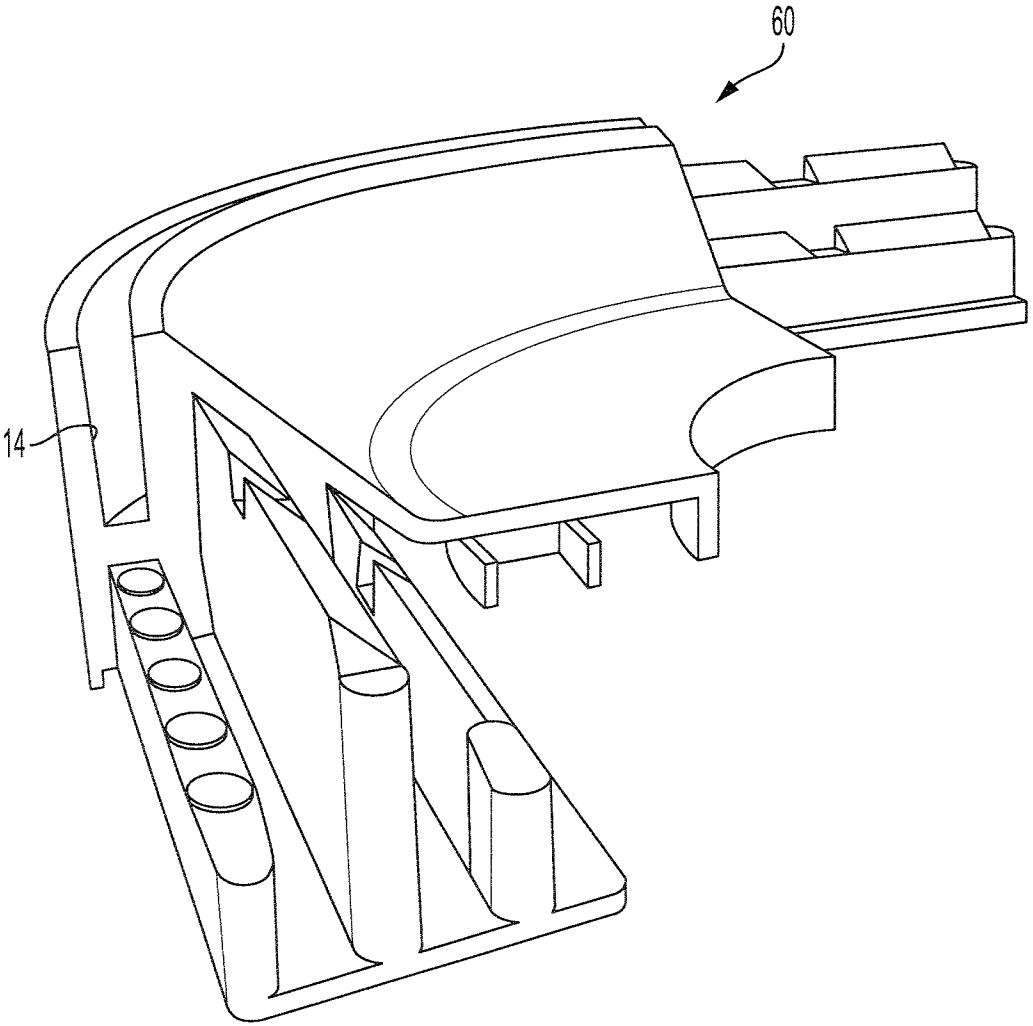
FIG. 28 shows a perspective view of the round connector shown in FIG. 27.

FIGS. 27, 28 show a round bracket 66 for joining two channel members 10 forming a rounded, rather than square, corner. The round bracket 66 includes a rounded gasket channel 14 (see FIG. 28) providing for a continuous edge gasket 14 when connected to channel members 10. The round bracket 66 fits within the triangular channel 64 of the channel members 10, as described in reference to the three-way bracket 54, except that a separate connector is not required as the connector is built into the round bracket 66.

Figure 29B:
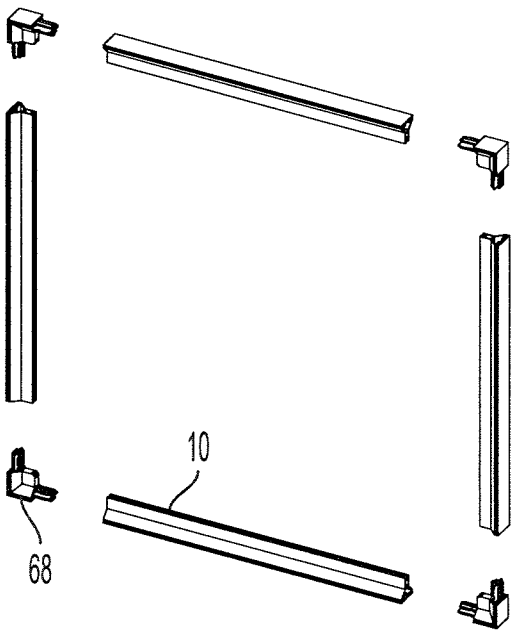
FIG. 29 (a) shows a side view of a deconstructed frame system having a square connector; (b) is a perspective view thereof; (c) is a close up view thereof.
Figure 29C:
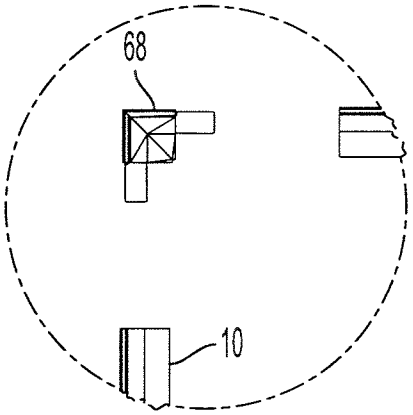
Figure 29A:
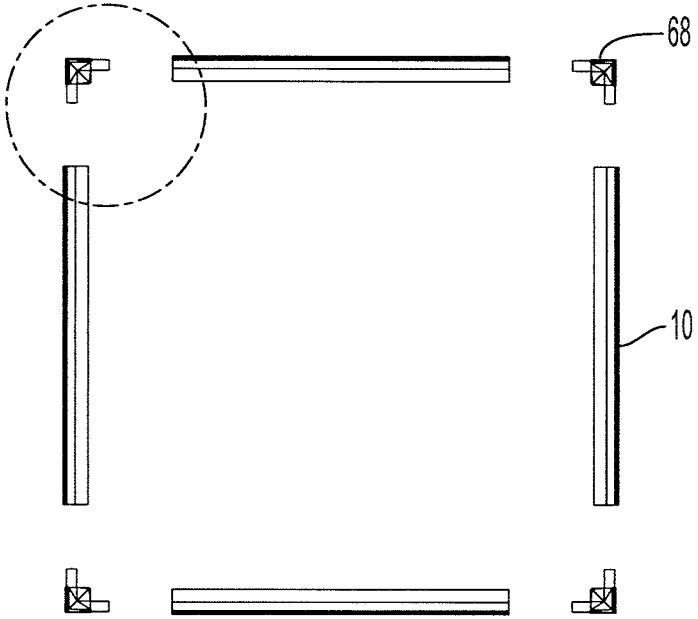
Figure 30:
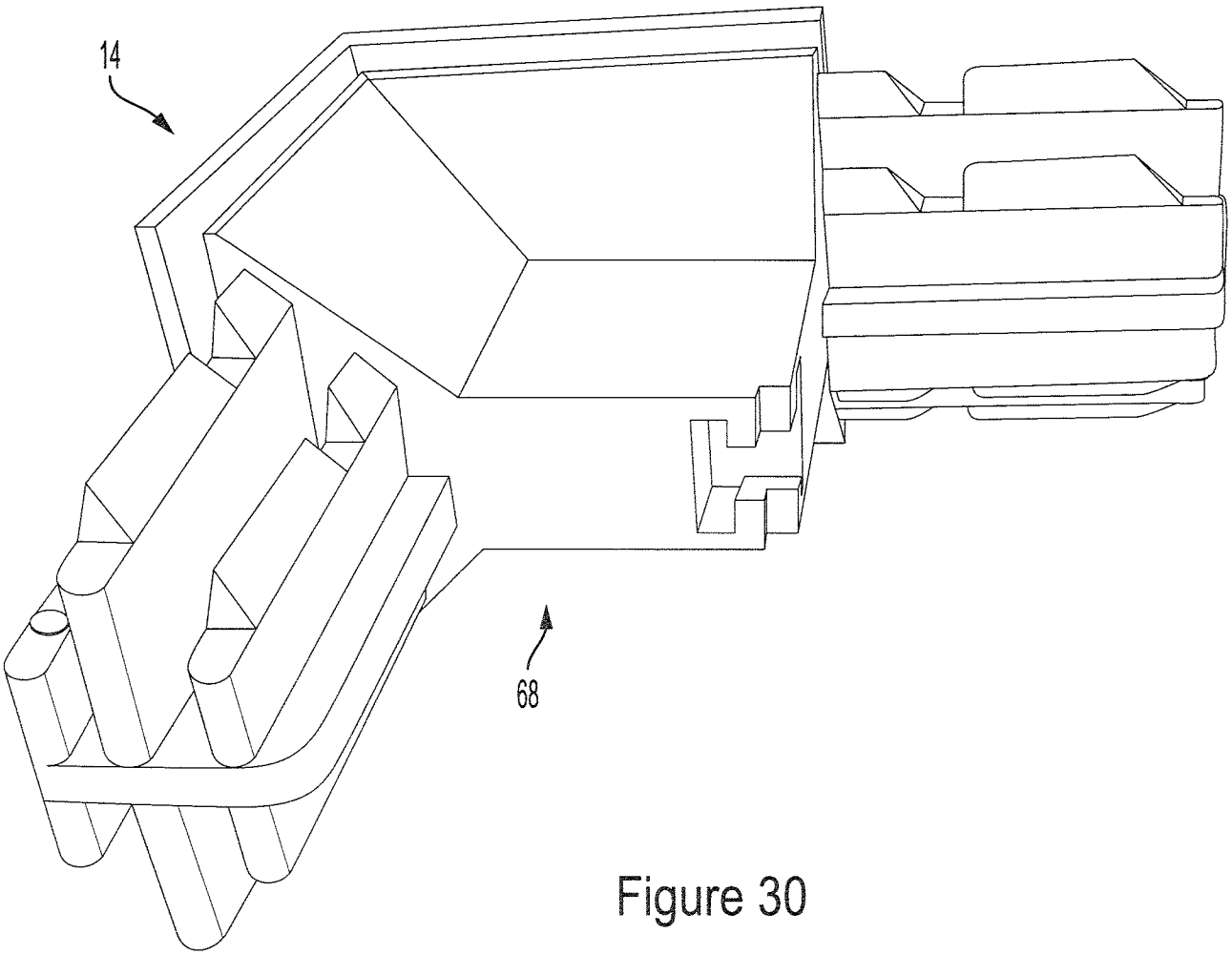
FIG. 30 shows a perspective view of the square connector shown in FIG. 29.

FIGS. 29, 30 show a square bracket 68 for joining channel members 10. The square bracket 68 also includes a gasket channel 14 providing for a continuous edge gasket 14 when connected to channel members 10. The square bracket 68 fits within the triangular channel 64 of the channel members 10, as described in reference to the round bracket 66.

Figure 31B:
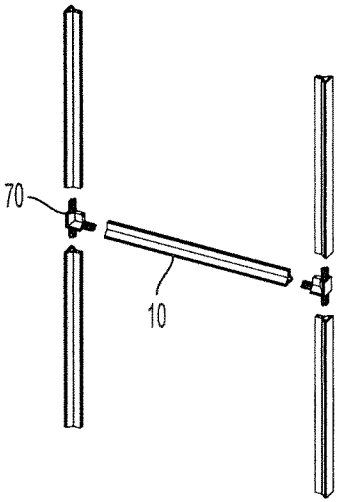
FIG. 31 (a) shows a side view of a deconstructed frame system having a t-connector; (b) is a perspective view thereof; (c) is a close up view thereof.
Figure 31C:
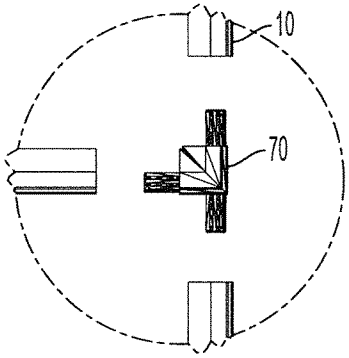
Figure 31A:
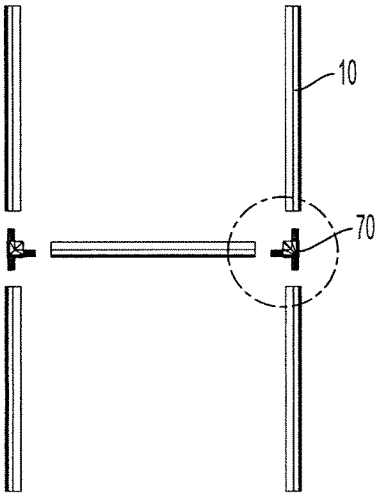
Figure 32:
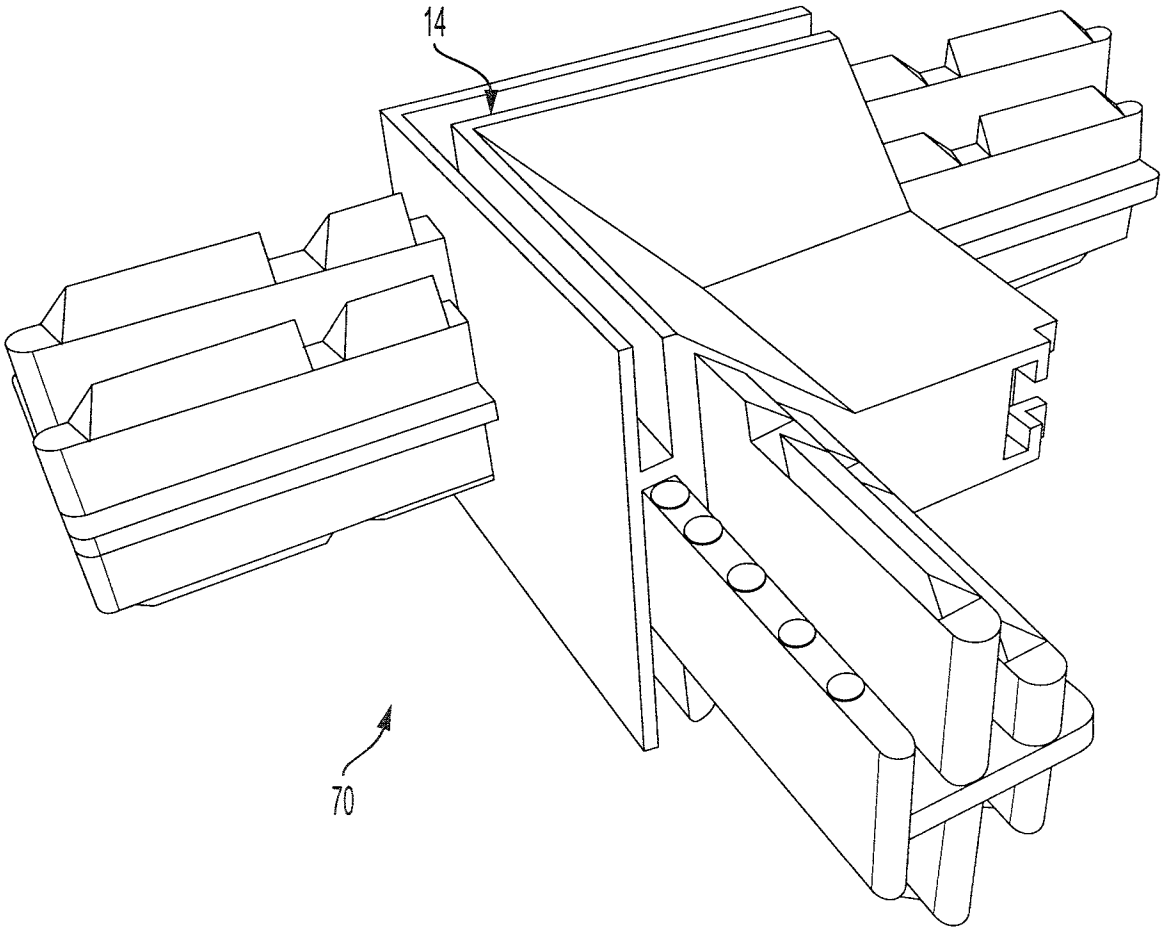
FIG. 32 shows a perspective view of the t-connector shown in FIG. 31.

FIGS. 31, 32 show a T-bracket 70. The T-bracket 70 can secure between one to three channel members 10 to create frames. The T-bracket 70 includes an L-shaped gasket channel 14, which can be useful if the SEG graphic 52 is intended to cover a portion of the frame—for example where the channel members 10 that are not covered by the SEG graphic 52 form legs connecting to a stand. The T-bracket 70 fits within the triangular channel 64 of the channel members 10, as described in reference to the round bracket 66 and the square bracket 68.

The above specification and accompanying Figures are for illustrative use only. The scope of the present invention is defined by the following claims. The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention. Those of ordinary skill in the art that have the disclosure before them will be able to make modifications and variations therein without departing from the scope of the invention.

The invention claimed is:

1. A frame system, comprising:

a plurality of channel members for forming an enclosure, the channel members having an outside surface forming an exterior perimeter around the enclosure, an inside surface forming an interior perimeter, a first and second side surfaces between the outside and inside surfaces, an interior channel between within the surfaces;

a first and second gasket channels on either side of the outside surface of the channel members;

a hardware channel on the inside surface of the channel members adapted for receipt of connectors within the hardware channel;

a first and second side channels on the first and second side surfaces, the side channels adapted for receipt within the side channels of L-shaped brackets in the side channels to connect the channel members;

a plurality of brackets for connecting the channel members to form an enclosure, and brackets connected to either the first side channels, second side channels, or the interior channels;

a plurality of braces having hollow ends;

a plurality of connectors for connecting the hollow ends of the braces to the hardware channel and for connecting the opposite hollow ends of the braces to each other to form internal support for the frame system;

a panel having a gasket edge adapted to engage with either the first or second gasket channels.

2. The frame system of claim 1 where the connectors have a foot that engages a slot in the hardware channel of the channel member, and the opposite end of the connectors inserts into the hollow cavity in the brace and a button on the connectors engages with a hole in the brace to engage the connector.

3. The system of claim 2 where the button is sloped so that a low side inserts into the hollow cavity first and the high side inserts after the low side.

4. The frame system of claim 1 where the panel is an SEG graphic panel.

5. The frame system of claim 1 where at least some of the brackets comprises barbs for securing engagement with the interior channel of the channel members.

6. The system of claim 1 where at least some of the brackets comprises indents for securing engagement with the interior channel of the channel members.

7. The system of claim 6 wherein the braces comprise holes, and further comprising at least one post connected to at least one of the holes, wherein the posts pass through holes in the panel.

8. The system of claim 7 further comprising a second panel connected to the at least one post.

9. The system of claim 8 further comprising an SEG panel engaged in the gasket channel, where the one or more posts protrude through holes in the SEG panel.

10. The system of claim 1 where at least one of the brackets is a round bracket, and the round bracket has a gasket channel.

11. The system of claim 1 where at least one of the brackets is a square bracket, and the square bracket has a gasket channel.

12. The system of claim 1 where at least one of the brackets is a t-bracket, and a portion of the t-bracket has a gasket channel.

13. The system of claim 1 where the interior channel is a first interior channel and further comprising a second interior channel located between the first interior channel and the gasket channels.

14. The system of claim 13 where the second interior channel has sloped sides whereby the second interior channel has a generally triangular cross-sectional profile for strength.

15. The system of claim 1 further comprising a center connector for connecting braces to each other.

16. The system of claim 15 where the center connector connects for four braces.

17. The system of claim 16 where center connector has four sloped buttons for inserting into the hollow cavity of the four braces, and so that a low side of the buttons insert into the hollow cavities first and a high side inserts after the low side.

18. The system of claim 17 where the buttons are captured by holes in the braces.

19. The system of claim 1 further comprising two center connectors for connecting braces to each other.

* * * * *